US009441842B2

(12) United States Patent
Nouchi

(10) Patent No.: US 9,441,842 B2
(45) Date of Patent: Sep. 13, 2016

(54) INDOOR UNIT OF AIR CONDITIONING APPARATUS

(75) Inventor: Yoshiteru Nouchi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1124 days.

(21) Appl. No.: 13/504,584

(22) PCT Filed: Oct. 28, 2010

(86) PCT No.: PCT/JP2010/069164

§ 371 (c)(1),
(2), (4) Date: Apr. 27, 2012

(87) PCT Pub. No.: WO2011/055676

PCT Pub. Date: May 12, 2011

(65) Prior Publication Data

US 2012/0214398 A1 Aug. 23, 2012

(30) Foreign Application Priority Data

Nov. 5, 2009 (JP) ..... 2009-254308

(51) Int. Cl.

| | |
|---|---|
| ***F24F 7/00*** | (2006.01) |
| ***F25D 17/06*** | (2006.01) |
| ***F24D 5/10*** | (2006.01) |
| ***F24F 1/00*** | (2011.01) |
| *F24F 13/06* | (2006.01) |

(52) U.S. Cl.
CPC ..... *F24F 1/0014* (2013.01); *F24F 2001/0037* (2013.01); *F24F 2013/0616* (2013.01)

(58) Field of Classification Search
USPC ..... 454/256; 62/426; 165/53
IPC ..... F24F 1/0014,5/0017, 5/0007, 1/02, F24F 2001/0037, 2013/0616
See application file for complete search history.

(56) References Cited

U.S. PATENT DOCUMENTS

| | | | | |
|---|---|---|---|---|
| 6,250,373 | B1 * | 6/2001 | Vecchi et al. | 165/53 |
| 8,511,108 | B2 * | 8/2013 | Yabu et al. | 62/426 |
| 2010/0192611 | A1 | 8/2010 | Yamaguchi et al. | |

FOREIGN PATENT DOCUMENTS

| | | | |
|---|---|---|---|
| EP | 1310743 | A1 * | 5/2003 |
| JP | 9-145138 | A | 6/1997 |
| JP | 10-205795 | A | 8/1998 |
| JP | 2001-304675 | A | 10/2001 |
| JP | 2002-81733 | A | 3/2002 |
| JP | 2002-349892 | A | 12/2002 |
| JP | 2004-77016 | A | 3/2004 |
| JP | 3624814-82 | | 12/2004 |
| JP | 2005-249328 | A | 9/2005 |
| JP | 2008-209099 | A | 9/2008 |
| WO | WO-2009/054316 | A1 | 4/2009 |

OTHER PUBLICATIONS

JP 9-143138, Yanagida, See IDS filed Apr. 27, 2012.*
JP 2004-77016-A, Shirakawa, See IDS filed Apr. 27, 2012.*
JP 2005-249328-A, Ikeda, See IDS filed Apr. 27, 2012.*
International Preliminary Report of corresponding PCT Application No. PCT/JP2010/069164.
International Search Report of corresponding PCT Application No. PCT/JP2010/069164.

* cited by examiner

*Primary Examiner* — Helena Kosanovic
(74) *Attorney, Agent, or Firm* — Global IP Counselors

(57) ABSTRACT

An indoor unit of an air conditioning apparatus includes an door unit casing and an airflow direction adjusting member. The indoor unit casing has an air inlet and an air outlet with an edge on an air inlet side forming a bulge toward the air inlet. The airflow direction adjusting member covers at least part of the air outlet. The airflow direction adjusting member has an edge on the air inlet side forming a bulge toward the air inlet.

9 Claims, 16 Drawing Sheets

INDOOR UNIT OF AIR CONDITIONING APPARATUS

CROSS-REFERENCE TO RELATED APPLICATIONS

This U.S. National stage application claims priority under 35 U.S.C. §119(a) to Japanese Patent Application No. 2009-254308, filed in Japan on Nov. 5, 2009, the entire contents of which are hereby incorporated herein by reference.

TECHNICAL FIELD

The present invention relates to an indoor unit of an air conditioning apparatus.

BACKGROUND ART

As an indoor unit of an air conditioning apparatus, there is, as described in Japanese Patent Publication No. 2002-349892 for example, an indoor unit of an air conditioning apparatus where air outlets are disposed around an air inlet. In this indoor unit of an air conditioning apparatus, a wide range of a target space can be conditioned by conditioned air blown out from the air outlets.

SUMMARY

Technical Problem

In the indoor unit of the air conditioning apparatus described in Japanese Patent Publication No. 2002-349892, the shape of the air outlets is a rectangle formed in such a way that the length in the lengthwise direction is much longer than the length in the width direction. For this reason, it is difficult to cause the conditioned air blown out from the air outlets to reach even farther.

With respect to this, it is also conceivable to improve the far reach of the conditioned air by relatively increasing the length in the width direction with respect to the length in the lengthwise direction in regard to the shape of the air outlets.

However, in the case of increasing the length in the width direction, this ends up increasing the size of the lower surface of the indoor unit.

With respect to this, by enlarging the shape of the air outlets toward the air inlet side, the ability of the conditioned air to have a far reach can be improved while suppressing an increase in the size of the lower surface of the indoor unit.

However, when the shape of the air outlets ends up being enlarged toward the air inlet side in this way, the problem of short-circuiting, in which the conditioned air that has been blown out from the air outlets ends up soon being sucked back in from the nearby air inlet, arises.

The present invention has been made in view of the above-described circumstances, and it is a problem of the present invention to provide an indoor unit of an air conditioning apparatus that can increase the blow distance of conditioned air blown out from an air outlet while suppressing short-circuiting and an increase in the size of the lower surface of the indoor unit.

Solution to Problem

An indoor unit of an air conditioning apparatus of first aspect of the invention is equipped with an indoor unit casing and an airflow direction adjusting member. The indoor unit casing has an air inlet and an air outlet whose edge on the air inlet side bulges toward the air inlet. The airflow direction adjusting member covers at least part of the air outlet, with an edge on the air inlet side bulging toward the air inlet side.

In this indoor unit of an air conditioning apparatus, the air outlet is formed bulging toward the air inlet side, so the blow distance of the conditioned air can be increased by increasing the air flux to make it easier to maintain the initial speed of the conditioned air passing through the neighborhood of the center of the air outlet. Additionally, the direction in which the air outlet bulges is toward the air inlet side, on an increase in the size of the lower surface of the indoor unit can be suppressed. Moreover, by allowing the air outlet to bulge toward the air inlet side in this manner, the air outlet and the air inlet end up becoming closer to each other in distance, but because the shape of the air inlet side of the airflow direction adjusting member is, like that of the air outlet, a shape bulging toward the air inlet side, it can be made easier to block the airflow heading toward the air inlet from the section of the air outlet on the air inlet side, so that short-circuiting can be suppressed. Because of this, it becomes possible to increase the blow distance of the conditioned air blown out from the air outlet while suppressing short-circuiting and an increase in the size of the lower surface of the indoor unit.

An indoor unit of an air conditioning apparatus of a second aspect of the invention is the indoor unit of an air conditioning apparatus of the first aspect of the invention, wherein the indoor unit is a ceiling-embedded type. Additionally, the indoor unit has a structure that directs the direction of airflows blown out from the neighborhoods of lengthwise direction end portions of the air outlet more downward than the direction of an airflow blown out from a lengthwise direction center of the air outlet. This directing of the flow direction of the air blown out from the neighborhoods of the lengthwise direction end portions of the air outlet more downward than the flow direction of the air blown out from the lengthwise direction center of the air outlet becomes possible with the air outlet alone, with the airflow direction adjusting member alone, or as a result of the air outlet and the airflow direction adjusting member working cooperatively.

Usually, in the neighborhoods of the lengthwise direction end portions of the air outlet, the airflows are slower than in the neighborhood of the lengthwise direction center and the air tends to flow along the ceiling surface.

With respect to this, in this indoor unit of an air conditioning apparatus, the conditioned air blown out from the neighborhoods of the lengthwise direction end portions of the air outlet can be guided in a direction further away from the ceiling surface than the conditioned air blown out from the center. Because of this, ceiling dirtying can be suppressed.

An indoor unit of an air conditioning apparatus of a third aspect of the invention is the indoor unit of an air conditioning apparatus of the second aspect of the invention, wherein the air outlet is formed in such a way that the inclination of edge surfaces in the neighborhoods of the lengthwise direction end portions is steeper than the inclination of an edge surface in the lengthwise direction center.

In this indoor unit of an air conditioning apparatus, no matter what direction the airflow direction adjusting member is facing, the flow direction of the air blown out from the neighborhoods of the lengthwise direction end portions of the air outlet can be guided in a direction away from the ceiling surface, so the effect of preventing ceiling dirtying can be more reliably obtained.

An indoor unit of an air conditioning apparatus of a fourth aspect of the invention is the indoor unit of an air conditioning apparatus of either the second aspect of the invention or the third aspect of the invention, wherein the bulge of the air outlet is formed as a result of its width direction length becoming shorter towards the end portions in the neighborhoods of the lengthwise direction end portions. The bulge of the airflow direction adjusting member is formed as a result of its width direction length becoming shorter toward the end portions in the neighborhoods of the lengthwise direction end portions.

In this indoor unit of an air conditioning apparatus, the width direction length is formed shorter toward the lengthwise direction end portions of the air outlet, so the air flux of the airflow passing through the center of the air outlet can be increased to make it easier for the airflow to maintain its initial speed, and it becomes possible to more effectively increase the blow distance of the conditioned air blown out from the air outlet.

An indoor unit of an air conditioning apparatus of a fifth aspect of the invention is the indoor unit of an air conditioning apparatus of the fourth aspect of the invention, wherein the width direction length, at the lengthwise direction end portions, of the air outlet is 40 to 80% of the width direction length at the lengthwise direction center. The air outlet has a linearly shaped section that interconnects the sections of the bulge in the neighborhoods of the lengthwise direction end portions. The width direction length, at the lengthwise direction end portions, of the airflow direction adjusting member is 20 to 60% of the width direction length at the lengthwise direction center. The airflow direction adjusting member has a linearly shaped section that interconnects the sections of the bulge in the neighborhoods of the lengthwise direction end portions.

In this indoor unit of an air conditioning apparatus, the air outlet has the linearly shaped section whose width is wider than the end portions, so the blow distance of the conditioned air can be increased. Additionally, the airflow direction adjusting member has the same shape, so the function of adjusting the airflow direction of the conditioned air passing through the air outlet can be ensured. Because of this, it becomes possible to increase the blow distance of the conditioned air while ensuring an airflow direction adjusting function.

An indoor unit of an air conditioning apparatus of a sixth aspect of the invention is the indoor unit of an air conditioning apparatus of the fourth aspect of the invention or the fifth aspect of the invention, wherein the degree of bulging of the air outlet toward the air inlet side is at least greater than the degree of bulging of the air outlet toward the opposite side of the air inlet side. The degree of bulging of the airflow direction adjusting member toward the air inlet side is at least greater than the degree of bulging of the airflow direction adjusting member toward the opposite side of the air inlet side.

The speed of the air blown out from the air outlet becomes lower, and it becomes easier for short-circuiting to occur, as approaching the lengthwise direction end portions of the air outlet, but this indoor unit of an air conditioning apparatus suppresses the short-circuiting because the air outlet of this indoor unit of an air conditioning apparatus is formed in such a way that the distance between the air outlet and the air inlet increases as approaching the lengthwise direction end portions, it becomes possible to more effectively increase the blow distance of the conditioned air blown out from the air outlet because the air flux of the air blown out from the center of the air outlet of this indoor unit of an air conditioning apparatus is thick and the air flux of the air blown out from the center of the air outlet of this indoor unit of an air conditioning apparatus is likely to be maintained its initial speed. Further, the degree of bulging of the airflow direction adjusting member toward the air inlet side is raised, like the shape of the air outlet, without giving the airflow direction adjusting member a shape where the air inlet side is cut out in the neighborhoods of the lengthwise direction end portions. For this reason, short-circuiting, which is caused by air leaking out from between the sections of the airflow direction adjusting member on the air inlet side in the neighborhoods of the lengthwise direction end portions and the sections of the air outlet on the air inlet side in the neighborhoods of the lengthwise direction end portions, can be suppressed.

An indoor unit of an air conditioning apparatus of a seventh aspect of the invention is the indoor unit of an air conditioning apparatus of any of the second aspect of the invention to the sixth aspect of the invention, wherein the air outlet does not have a section with a shape recessed toward the inside of the air outlet. The edge of the airflow direction adjusting member does not have a section with a shape recessed toward the inside of the airflow direction adjusting member.

This indoor unit of an air conditioning apparatus does not have a section with an inwardly recessed shape, so it becomes possible to more effectively prevent ceiling dirtying.

An indoor unit of an air conditioning apparatus of an eighth aspect of the invention is the indoor unit of an air conditioning apparatus of any of the first aspect of the invention to the seventh aspect of the invention, wherein the air inlet side of the airflow direction adjusting member is formed in such a way as to follow the air inlet side of the air outlet.

In this indoor unit of an air conditioning apparatus, short-circuiting of the air flowing toward the air inlet side from the end portions of the air outlet on the air inlet side can be more effectively prevented, and the design can also be improved in regard to the shape relationship between the air outlet and the airflow direction adjusting member.

An indoor unit of an air conditioning apparatus of a ninth aspect of the invention is the indoor unit of an air conditioning apparatus of any of the first aspect of the invention to the eighth aspect of the invention, wherein as for the air outlet in which the airflow direction adjusting member is disposed, at least four are disposed in such a way as to surround the air inlet.

In this indoor unit of an air conditioning apparatus, a wide target space capable of being conditioned can be ensured because the conditioned air is blown out in four directions.

An indoor unit of an air conditioning apparatus of a tenth aspect of the invention is the indoor unit of an air conditioning apparatus of the ninth aspect of the invention and is further equipped with continuous air outlets. The continuous air outlets are further disposed between the air outlets in addition to the air outlets in which the airflow direction adjusting members are disposed.

This indoor unit of an air conditioning apparatus is further equipped with the continuous air outlets, so it becomes possible to provide conditioned air thoroughly around the indoor unit. Additionally, when the total area in which the conditioned air is blown out becomes larger as a result of the continuous air outlets being disposed in this way, there is the concern that it will be difficult to maintain the initial speed of the conditioned air passing through the air outlets in which the airflow direction adjusting members are disposed, but even in that case, by employing a shape bulging inward in regard to the shape of the air outlets, it becomes possible to keep the extent to which the initial speed of the conditioned air from the air outlets drops small.

An indoor unit of an air conditioning apparatus of an eleventh aspect of the invention is the indoor unit of an air conditioning apparatus of any of the first aspect of the invention to the tenth aspect of the invention and is further equipped an airflow direction adjusting control unit. The airflow direction adjusting control unit adjusts the direction of the airflow blown out from the air outlet by adjusting the posture of the airflow direction adjusting member. The airflow direction adjusting control unit adjusts the posture of the airflow direction adjusting member in such a way as to close the air outlet when air conditioning operations are stopped.

In this indoor unit of an air conditioning apparatus, the inside of the air outlet is covered by the airflow direction adjusting member when air conditioning operations are stopped, so it becomes difficult to be able to see the inside of the indoor unit, and the design can be improved.

Advantageous Effects of Invention

In the indoor unit of an air conditioning apparatus pertaining to the first aspect of the invention, it becomes possible to increase the blow distance of the conditioned air blown out from the air outlet while suppressing short-circuiting and an increase in the size of the lower surface of the indoor unit.

In the indoor unit of an air conditioning apparatus pertaining to the second aspect of the invention, ceiling dirtying can be suppressed.

In the indoor unit of an air conditioning apparatus pertaining to the third aspect of the invention, the effect of preventing ceiling dirtying can be more reliably obtained.

In the indoor unit of an air conditioning apparatus pertaining to the fourth aspect of the invention, it becomes possible to more effectively increase the blow distance of the conditioned air blown out from the air outlet.

In the indoor unit of an air conditioning apparatus pertaining to the fifth aspect of the invention, it becomes possible to increase the blow distance of the conditioned air while ensuring an airflow adjusting function.

In the indoor unit of an air conditioning apparatus pertaining to the sixth aspect of the invention, the air flux of the airflow blown out from the center of the air outlet can be increased to make it easier for the airflow to maintain its initial speed, and it becomes possible to increase the blow distance of the conditioned air.

In the indoor unit of an air conditioning apparatus pertaining to the seventh aspect of the invention, it becomes possible to more effectively prevent ceiling dirtying.

In the indoor unit of an air conditioning apparatus pertaining to the eighth aspect of the invention, short-circuiting can be suppressed while improving the design.

In the indoor unit of an air conditioning apparatus pertaining to the ninth aspect of the invention, a wide target space capable of being conditioned can be ensured.

In the indoor unit of an air conditioning apparatus pertaining to the tenth aspect of the invention, conditioned air can be supplied thoroughly around the indoor unit while suppressing a drop in the blow distance of the conditioned air.

In the indoor unit of an air conditioning apparatus pertaining to the eleventh aspect of the invention, the inside of the air outlet is covered by the airflow direction adjusting member when air conditioning operations are stopped, so it becomes difficult to be able to see the inside of the indoor unit, and the design can be improved.

DESCRIPTION OF EMBODIMENT

A ceiling-mounted air conditioning apparatus pertaining to an embodiment of the present invention will be described below with reference to the drawings.

<1> Air Conditioning Apparatus 1

Figure 1:
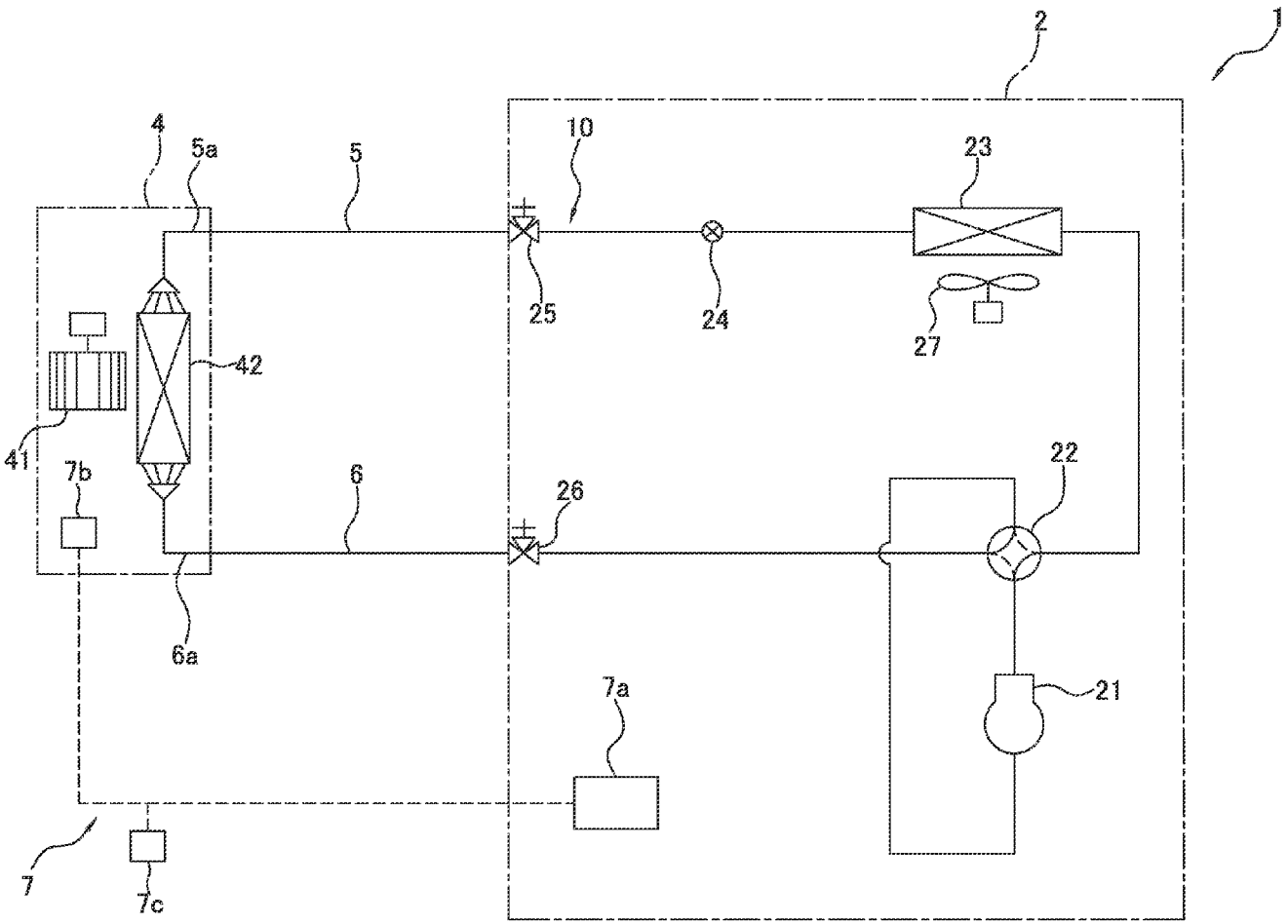
FIG. 1 is a schematic diagram of a refrigerant circuit showing a cooling operation state of an air conditioning apparatus pertaining to an embodiment of the present invention.

FIG. 1 is a schematic configuration diagram of an air conditioning apparatus 1 in which an indoor unit pertaining to the embodiment of the present invention is employed.

The air conditioning apparatus 1 is a type that is installed as a result of a type of indoor unit being embedded in a ceiling, has eight air outlets, and can independently rotate and control, per airflow direction adjusting plate, the angles of inclination of airflow direction adjusting plates disposed in four of the eight air outlets. The air conditioning apparatus 1 is a split type of air conditioning apparatus, mainly has an outdoor unit 2, an indoor unit 4, a liquid refrigerant connection tithe 5 and a gas refrigerant connection tube 6 that interconnect the outdoor unit 2 and the indoor unit 4, and a control unit 7, and configures a vapor compression refrigerant circuit 10.

<1-1> Outdoor Unit 2

The outdoor unit 2 is installed outdoors or the like and mainly has a compressor 21, a four-way switching valve 22, an outdoor heat exchanger 23, an expansion valve 24, a liquid-side stop valve 25, a gas-side stop valve 26, and an outdoor fan 27.

The compressor 21 is a compressor for sucking in low-pressure gas refrigerant, compressing the low-pressure gas refrigerant into high-pressure gas refrigerant, and thereafter discharging the high-pressure gas refrigerant.

The four-way switching valve 22 is a valve for switching the direction of the flow of the refrigerant when switching between cooling and heating. During cooling, the four-way switching valve 22 can interconnect the discharge side of the compressor 21 and the gas side of the outdoor heat exchanger 23 and also interconnect the gas-side stop valve 26 and the suction side of the compressor 21 (refer to the solid lines of the four-way switching valve 22 in FIG. 1). Further, during heating, the four-way switching valve 22 can interconnect the discharge side of the compressor 21 and the gas-side stop valve 26 and also interconnect the gas side of the outdoor heat exchanger 23 and the suction side of the compressor 21 (refer to the broken lines of the four-way switching valve 22 in FIG. 1).

The outdoor heat exchanger 23 is a heat exchanger that functions as a condenser of the refrigerant during cooling and functions as an evaporator of the refrigerant during heating. The liquid side of the outdoor heat exchanger 23 is connected to the expansion valve 24, and the gas side of the outdoor heat exchanger 23 is connected to the four-way switching valve 22.

The expansion valve 24 is a motor-driven expansion valve which, before sending the refrigerant to an indoor heat exchanger 42 (described later), can reduce the pressure of the high-pressure liquid refrigerant that has been condensed in the outdoor heat exchanger 23 during cooling and which, before sending the refrigerant to the outdoor heat exchanger 23, can reduce the pressure of the high-pressure liquid refrigerant that has been condensed in the indoor heat exchanger 42 during heating.

The liquid-side stop valve 25 and the gas-side stop valve 26 are valves disposed in openings that connect to external devices and pipes (specifically, the liquid refrigerant connection tube 5 and the gas refrigerant connection tube 6). The liquid-side stop valve 25 is connected to the expansion valve 24. The gas-side stop valve 26 is connected to the four-way switching valve 22.

The outdoor fan 27 is placed inside the outdoor unit 2 and forms an airflow that sucks in outdoor air, supplies the outdoor air to the outdoor heat exchanger 23, and thereafter discharges the outdoor air to the outside of the unit. For this reason, the outdoor heat exchanger 23 has the function of using the outdoor air as a cooling source or a heating source to condense and evaporate the refrigerant.

<1-2> Indoor Unit 4

In the present embodiment, the indoor unit 4 is a type of ceiling-mounted air conditioning apparatus indoor unit called a ceiling-embedded type and has an indoor unit casing 31, an indoor fan 41, an indoor heat exchanger 42, a drain pan 40, a bell mouth 41*c* and other components.

Figure 2:
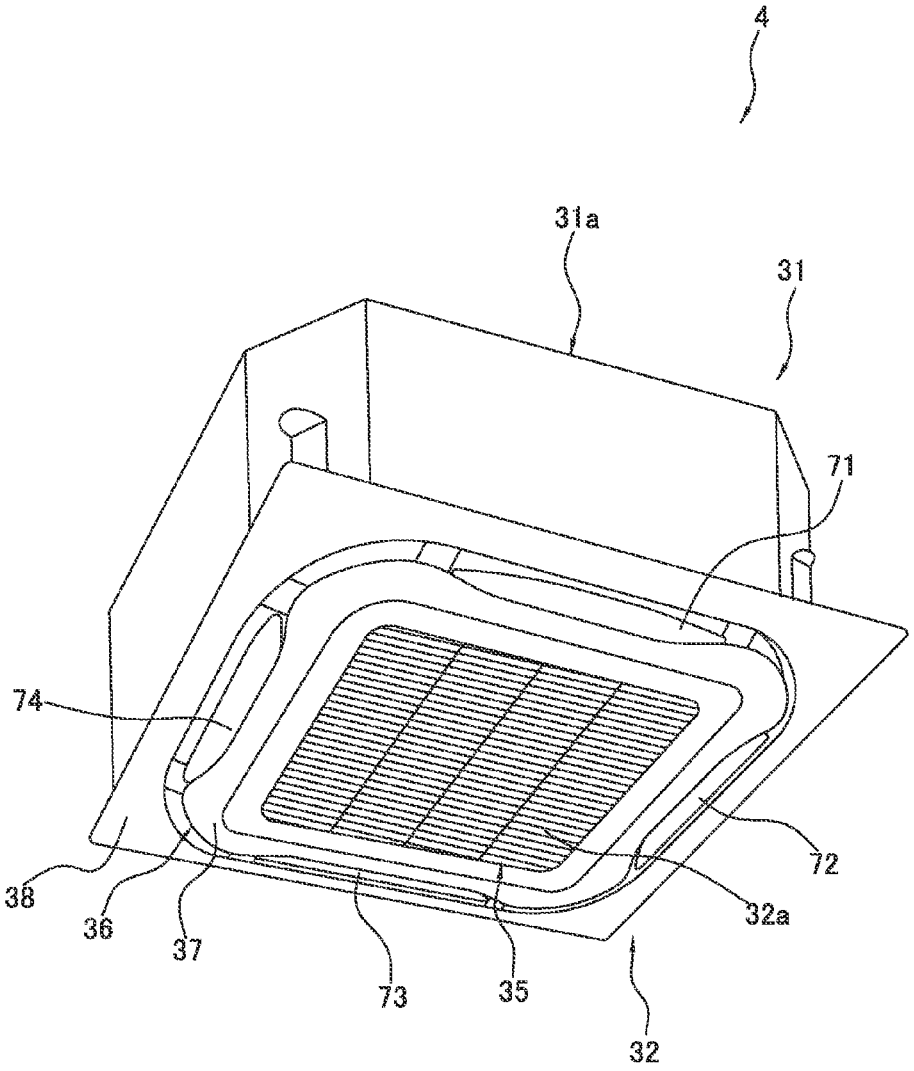
FIG. 2 is an external perspective view of an indoor unit of the air conditioning apparatus.
Figure 3:
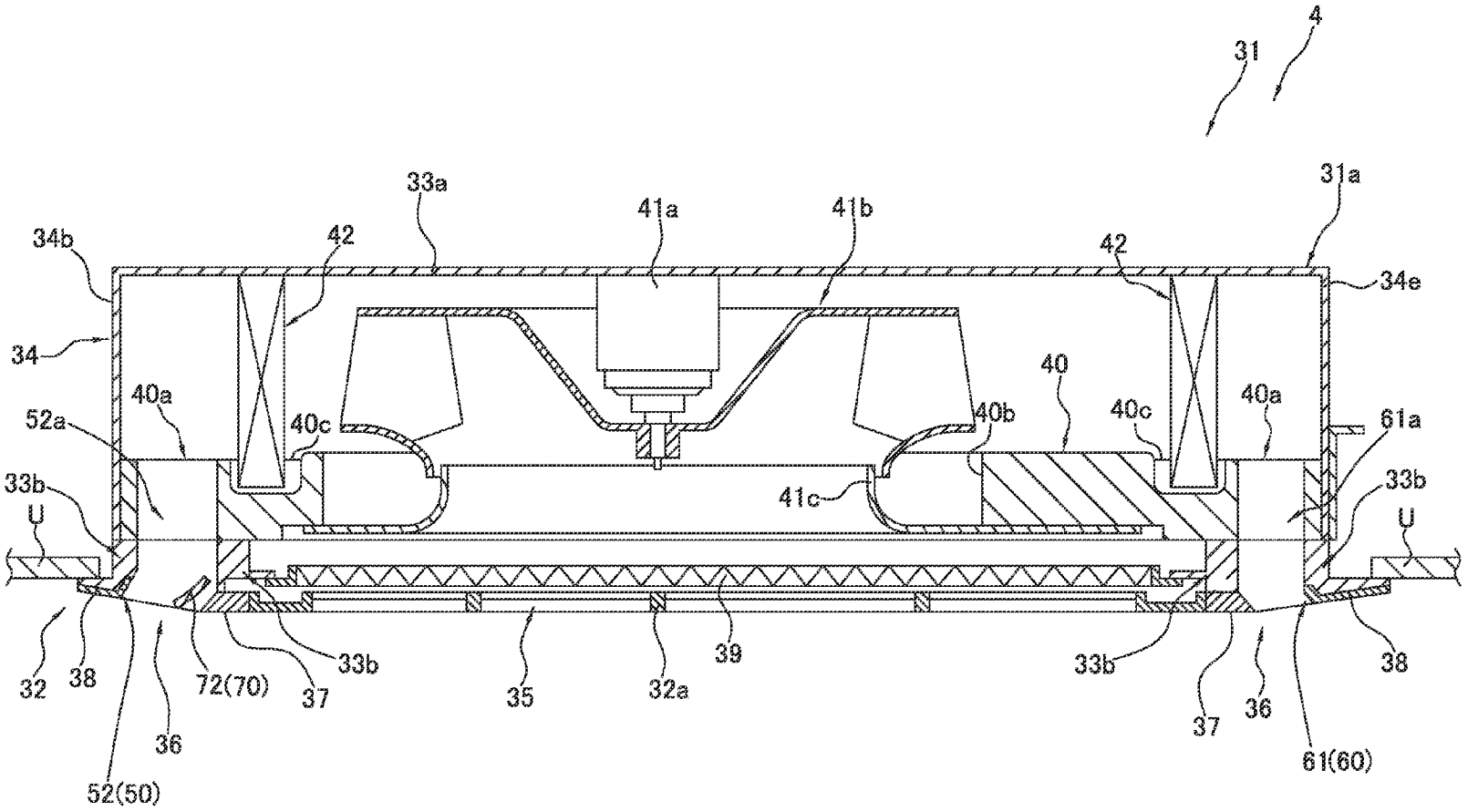
FIG. 3 is a schematic cross-sectional view, in cross section A-O-A in FIG. 4, of the indoor unit of the air conditioning apparatus.
Figure 4:
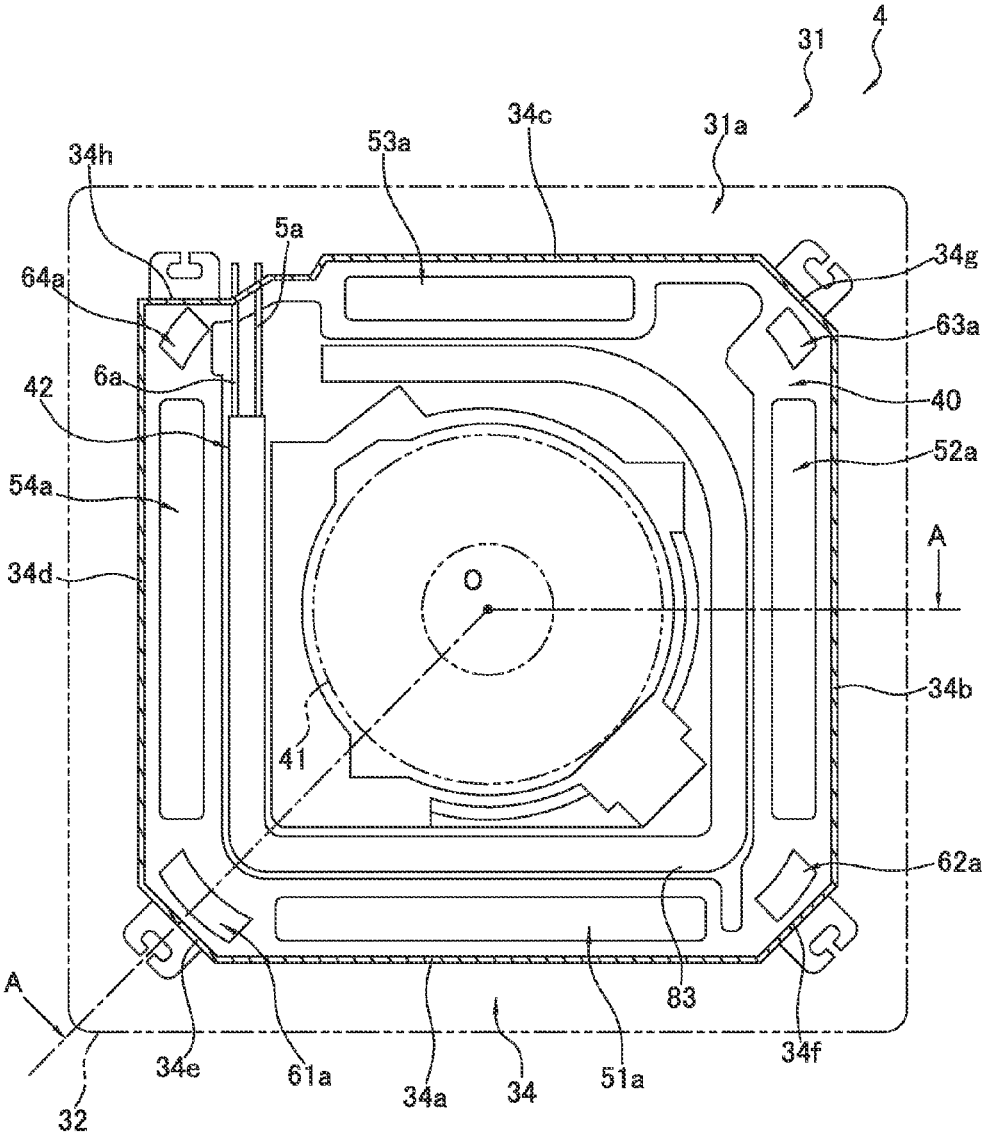
FIG. 4 is a schematic cross-sectional view, as seen from above, of the indoor unit of the air conditioning apparatus.

FIG. 2 is an external perspective view of the indoor unit 4. FIG. 4 is a schematic plan view showing a state where a top plate 33*a* of the indoor unit 4 has been removed. FIG. 3 is a schematic side sectional view of the indoor unit 4 and corresponds to a cross-sectional view in a cross section indicated A-O-A in FIG. 4.

The indoor unit casing 31 includes a casing body 31*a*, a decorative panel 32, and airflow direction adjusting portions 70.

Figure 6:
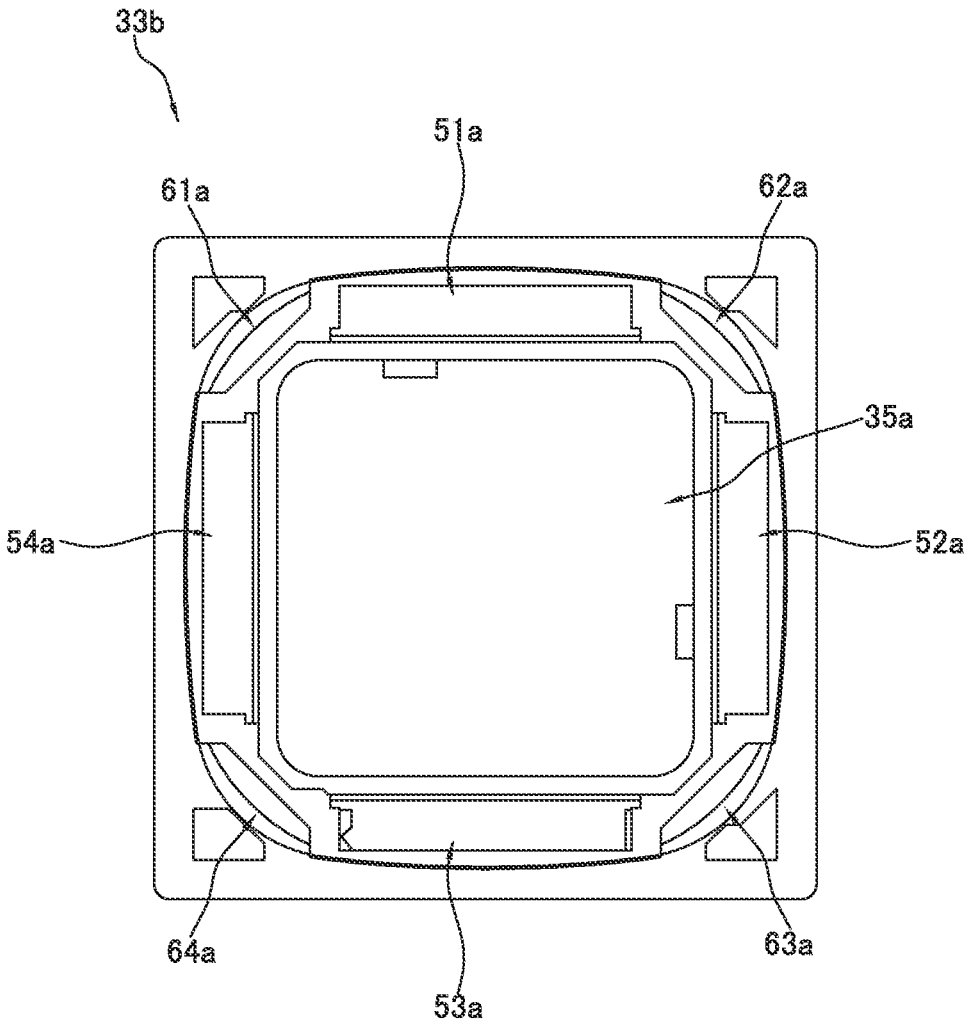
FIG. 6 is an external configuration view, as seen from below, of the indoor unit of the air conditioning apparatus.

As shown in FIG. 3 and FIG. 4, the casing body 31*a* is placed so as to be inserted in an opening formed in a ceiling U of an air-conditioned room. When the casing body 31*a* is seen from above, the casing body 31*a* is a substantially octagonal box-like body in which long sides and short sides are alternately formed, and the lower surface of the casing body 31*a* is open. The casing body 31*a* has a substantially octagonal top plate 33*a* in which long sides and short sides are alternately continuously formed, a side plate 34 that extends downward from the peripheral edge portion of the top plate 33*a*, and a bottom plate 33*b* that supports the top plate 33*a* and the side plate 34 from below. The side plate 34 is configured from side plates 34*a*, 34*b*, 34*c*, and 34*d*, which correspond to the long sides of the top plate 33*a*, and side plates 34*e*, 34*f*, 34*g*, and 34*h*, which correspond to the short sides of the top plate 33*a*. A liquid-side connecting tube 5*a* and a gas-side connecting tube 6*a* for interconnecting the indoor heat exchanger 42 and the refrigerant connection tubes 5 and 6 penetrate the side plate 34*h*. As shown in FIG. 6, which is a bottom view in a state where the decorative panel 32 and other components are not attached, a substantially quadrilateral opening is disposed in the center of the bottom plate 33*b*, plural openings are disposed around that opening, and the bottom plate 33*b* configures a lower surface of the casing body 31*a*. As shown in FIG. 3, the bottom plate 33*b* is formed so as to widen further outward than the top plate 33*a* and the side plate 34, and the decorative panel 32 is attached to the lower surface side (the room side) of the bottom plate 33*b*.

As shown in FIG. 3, FIG. 4, and FIG. 6, inside the casing 31*a* are disposed an air inlet flow path 35*a* for taking in air from an air inlet 35 into the inside of the casing body 31*a* and air outlet flow paths 51*a*, 52*a*, 53*a*, 54*a*, 61*a*, 62*a*, 63*a*, and 64*a* that are placed so as to surround the outside of the air inlet flow path 35*a*, have shapes extending in a substantially vertical direction, and are for blowing out conditioned air into the room.

Figure 5:
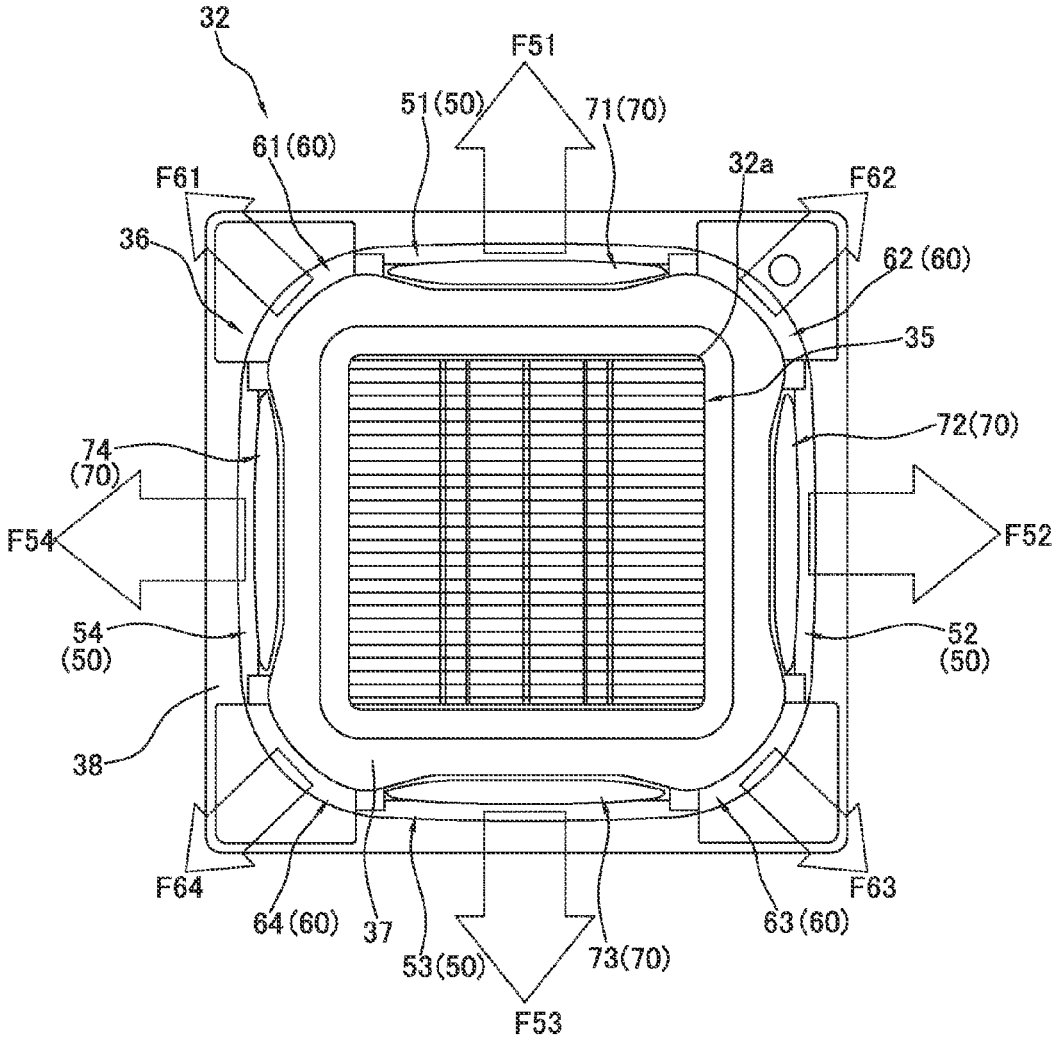
FIG. 5 is an external configuration view, as seen from below, of a bottom plate.

As shown in FIG. 2, FIG. 3, and FIG. 4, the decorative panel 32 is placed on as to be fitted into the opening in the ceiling U. The decorative panel 32 is a plate-like body having a substantially quadrilateral shape as seen from above and is mainly fixed to the lower end portion of the casing body 31*a* as a result of being attached from the room side with respect to the bottom plate 33*b* of the casing body 31*a*. As shown in FIG. 5, which is a bottom view of the indoor unit 4, the decorative panel 32 is configured by a suction grill 32*a*, an inner frame decorative panel 37, and an outer frame decorative panel 38, and has an air inlet 35 and an air outlet 36. In an installed state of the indoor unit 4, the lower end of the inner frame decorative panel 37 is placed so as to be positioned a little lower than the lower end of the outer frame decorative panel 38.

Figure 7:
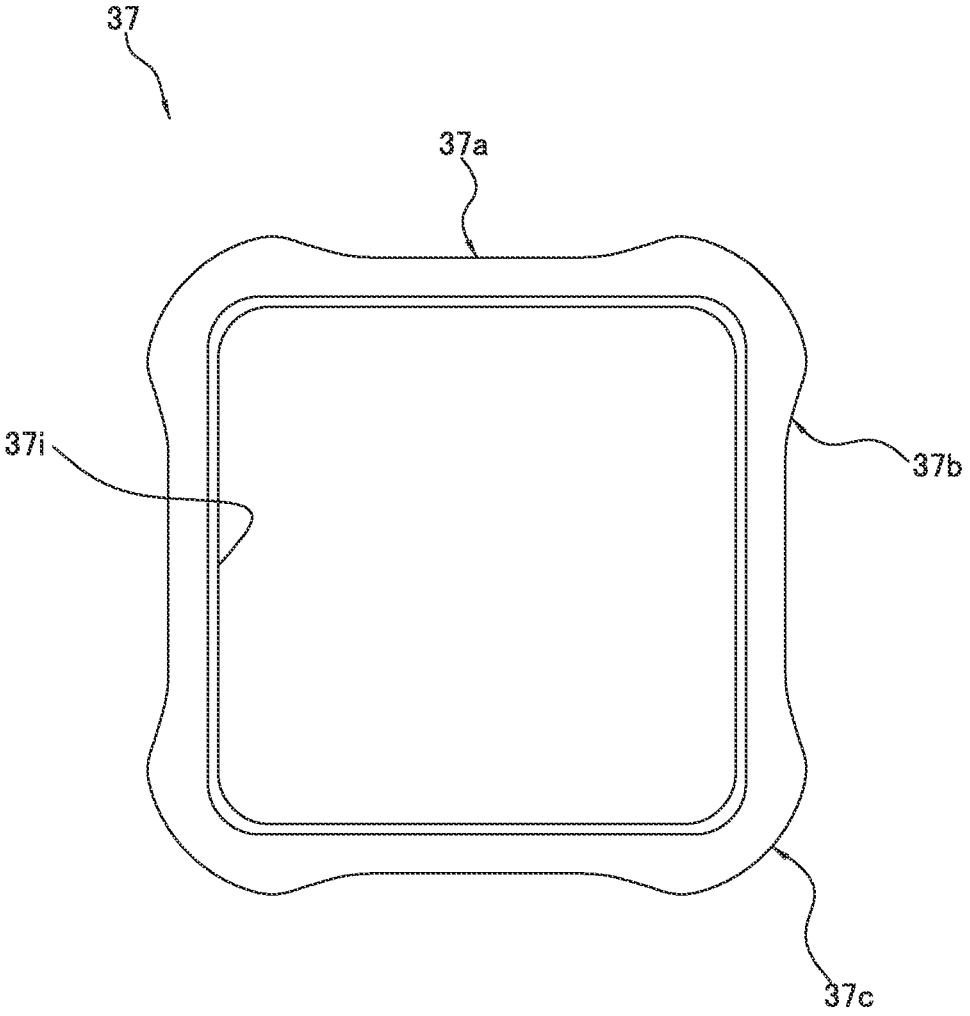
FIG. 7 is an external configuration view, as seen from below, of an inner frame decorative panel.
Figure 8:
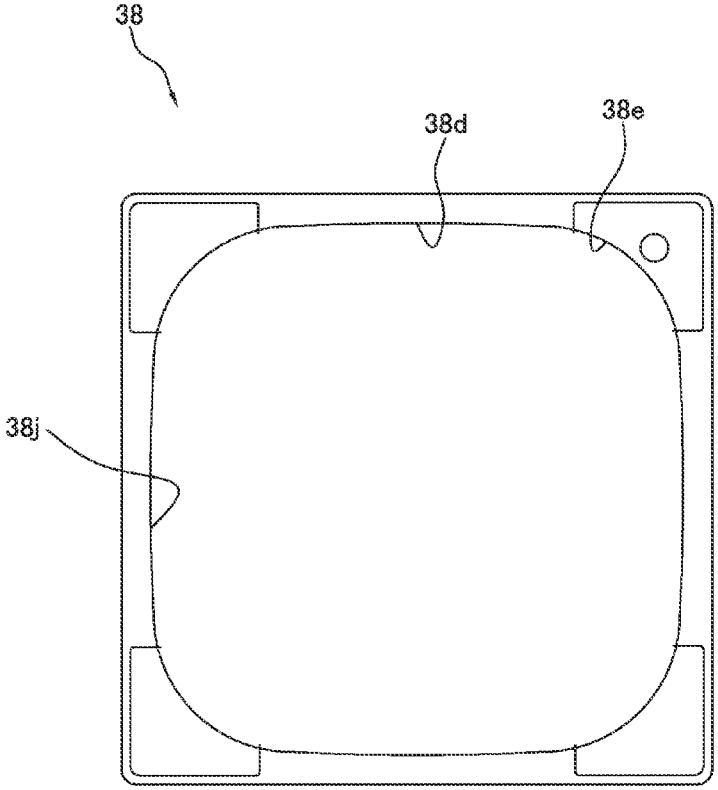
FIG. 8 is a cross-sectional view, as seen from the side, of an airflow direction adjusting portion.

The suction grill 32*a* is a substantially quadrilateral panel placed in the center of the lower surface of the casing body 31*a*. As shown in FIG. 7, which is a bottom view seen from the room side, the inner frame decorative panel 37 is a substantially quadrilateral frame member and is placed between the air inlet 35 and the air outlet 36. An inside edge 37*i* of the inner frame decorative panel 37 is substantially quadrilateral and has a shape whose corner sections are rounded. The outside edge of the inner frame decorative panel 37 includes inner frame air outlet-side linear portions 37*a*, inner frame air outlet-side curved portions 37*b*, and opening-inside bulging portions 37*c*. The inner frame air outlet-side linear portions 37*a* are sections that are disposed in outside positions corresponding to the neighborhoods of the centers of the four sides of the inside edge 37*i*, are substantially parallel to the sides of the inside edge 37*i*, and extend linearly. The inner frame air outlet-side curved portions 37*b* are formed in such a way that their edges are positioned further outward as approaching the corners of the inner frame decorative panel 37. The inner frame air outlet-side curved portions 37*b* have concave shapes recessed smoothly inward. The opening-inside bulging portions 37*c* configure the outer edges in the vicinities of the corners of the inner frame decorative panel 37 and have outwardly bulging shapes whose corners are rounded. The outer frame decorative panel 38 is placed so as to cover the outer edge of the lower surface of the casing body 31*a* and is placed on the outside of the air outlet 36. As shown in FIG. 8, which is a bottom view seen from the room side, an outside edge 38*j* of the outer frame decorative panel 38 is substantially quadrilateral, has a shape following the edge of the bottom plate 33*b* of the casing body 31*a*, and has rounded corners. The inside edge of the outer frame decorative panel 38 includes outer frame air outlet-side linear portions 38*d* and outer frame air outlet-side curved portions 38*e*. The outer frame air outlet-side linear portions 38*d* are sections that are disposed in inside positions corresponding to the neighborhoods of the centers of the four sides of the outside edge 38*j*, are substantially parallel to the sides of the outside edge 38*j*, and extend linearly. The outer frame air outlet-side curved portions 38*e* are formed in such a way that their edges are positioned further inward closer to the corners of the outer frame decorative panel 38. The outer frame air outlet-side curved portions 38*e* have convex shapes that bulge gently outward. The linear sections of the outer frame air outlet-side linear portions 38*d* are formed so as to be shorter than the linear sections of the inner frame air outlet-side linear portions 37*a*, and the percentage of the outer frame air outlet-side curved portions 38*e* in the length along the inner frame is large, so a bottom view of the outer frame air outlet-side linear portions 38*d* and the outer frame air outlet-side curved portions 38*e* shows they have a shape close to that of a circle.

The air inlet 35 is a substantially quadrilateral opening disposed in the substantial center of the suction grill 32*a*. A filter 39 for removing dirt and dust in the air that has been sucked in from the air inlet 35 is disposed in the air inlet 35. The above mentioned air inlet flow path 35*a* leads to the air inlet 35 on the inside of the casing body 31*a*.

The air outlet 36 is disposed between the inner frame decorative panel 37 and the outer frame decorative panel 38 so as to surround the periphery of the air inlet 35 and is configured from long-side air outlets 50 and short-side air outlets 60. The long-side air outlets 50 are configured from four air outlets a first long-side air outlet 51, a second long-side air outlet 52, a third long-side air outlet 53, and a fourth long-side air outlet 54 that are disposed in positions corresponding to the sides of the substantially quadrilateral shape of the air inlet 35. The tong-side air outlets 50 are formed so as to not have edge sections facing the inside of the opening. The long-side air outlets 50 are configured in such a way that the difference in length between their lengthwise direction and their width direction, which is a direction orthogonal to the lengthwise direction, is smaller than in a conventional air outlet (in such a way that the aspect ratio of the lengths is smaller than conventionally), so the air flux of the airflows blown out from the neighborhoods of the centers of the long-side air outlets 50 can be increased to make it easier for the airflows to maintain their initial speed. The short-side air outlets 60 are configured from four air outlets—a first short-side air outlet 61, a second short-side air outlet 62, a third short-side air outlet 63, and a fourth short-side air outlet 64—that are disposed in positions corresponding to the corner sections of the substantially quadrilateral shape of the air inlet 35. The air outlet 36 is configured in such a way that the long-side air outlets 50 and the short-side air outlets 60 are alternately arranged and placed in a substantially annular shape. The first long-side air outlet flow path 51*a*, the second long-side air outlet flow path 52*a*, the third long-side air outlet flow path 53*a*, and the fourth long-side air outlet flow path 54*a* lead respectively to the first long-side air outlet 51, the second long-side air outlet 52, the third long-side air outlet 53, and the fourth long-side air outlet 54. Further, the first short-side air outlet flow path 61*a*, the second short-side air outlet flow path 62*a*, the third short-side air outlet flow path 63*a*, and the fourth short-side air outlet flow path 64*a* lead respectively to the first short-side air outlet 61, the second short-side air outlet 62, the third short-side air outlet 63, and the fourth short-side air outlet 64.

Airflows F51, F52, F53, F54, F61, F62, F63, and F64 that have been conditioned inside the indoor unit 4 are blown out, while having their blow-out direction adjusted, respectively from the first long-side air outlet 51, the second long-side air outlet 52, the third long-side air outlet 53, the fourth long-side air outlet 54, the first short-side air outlet 61, the second short-side air outlet 62, the third short-side air outlet 63, and the fourth short-side air outlet 64.

Figure 9:
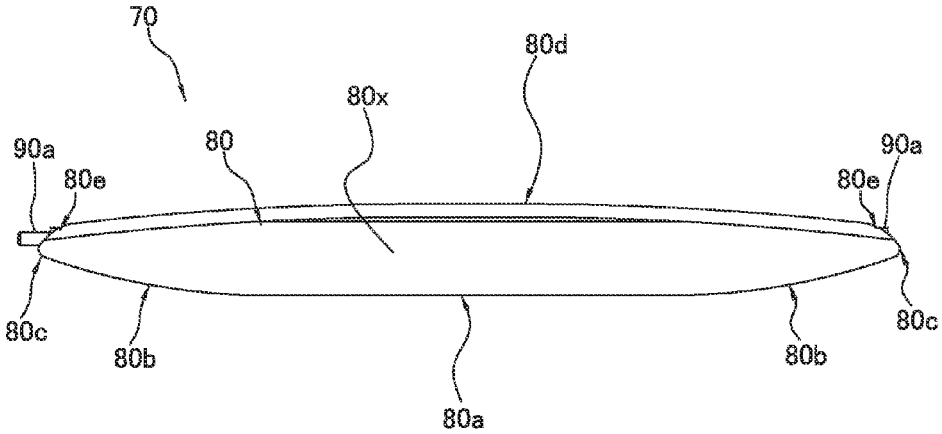
FIG. 9 is an external configuration view, as seen from below, of an outer frame decorative panel.
Figure 10:
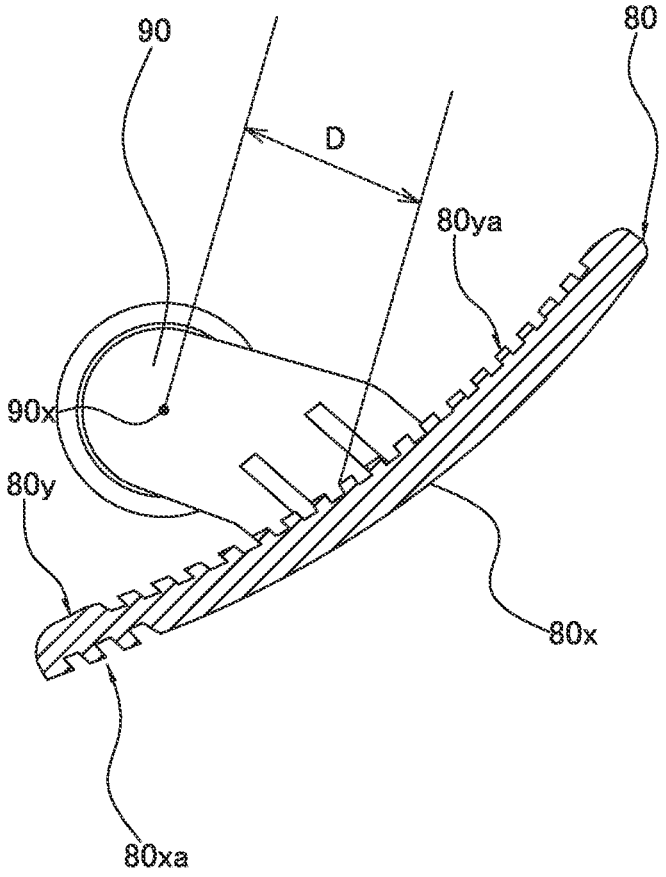
FIG. 10 is an external perspective view of the airflow direction adjusting portion.

As shown in FIG. 10, which is a cross-sectional view as seen in an axial direction, and in FIG. 9, which is an external perspective view regarding a surface mainly facing the room side, the airflow direction adjusting portions 70 have a shape that is long in an axis-of-rotation direction. The airflow direction adjusting portions 70 function as airflow direction adjusting plates that adjust the direction of the conditioned air blown out into the air-conditioned room. In the present embodiment, the airflow direction adjusting portions 70 are not placed in the short-side air outlets 60 of the air outlet 36 and are placed only in the long-side air outlets 50. The airflow direction adjusting portions 70 include a first airflow direction adjusting portion 71 that adjusts the direction of the conditioned air blown out from the first long-side air outlet 51, a second airflow direction adjusting portion 72 that adjusts the direction of the conditioned air blown out from the second long-side air outlet 52, a third airflow direction adjusting portion 73 that adjusts the direction of the conditioned air blown out from the third long-side air outlet 53, and a fourth airflow direction adjusting portion 74 that adjusts the direction of the conditioned air blown out from the fourth long-side air outlet 54.

As shown in FIG. 9, each of the airflow direction adjusting portions 70 has a flap body 80 and an arm 90 that includes a rotating shaft 90*x*.

The flap body 80 is a plate-shaped member formed so as to extend in a direction substantially parallel to the rotating shaft 90*x*, and a front surface 80*x* that is a surface on the opposite side of a back surface 80*y* that is a surface on the side where the arm 90 is attached has a curved shape projecting outward. The outer edge of the flap body 80 is formed so as to not have a section with an inwardly recessed shape. As shown in FIG. 10, in a state where the front surface 80*x* is mainly facing the room side (the blow-out airflow downstream side), the flap body 80 is disposed in such a way that the distance between the flap body 80 and the rotating shaft 90*x* becomes shorter as the flap body 80 becomes closer to the room side and is disposed in such a way that the distance between the flap body 80 and the rotating shaft 90*x* becomes longer as the flap body 80 becomes away from the room side (heading toward the blow-out airflow upstream side). Because of this, in a case where the airflow direction adjusting portion 70 has rotated, the airflow direction adjusting portion 70 follows a trajectory that differs between one end and the other end of the flap body 80. As shown in FIG. 10, a concavo-convexly shaped portion 80*xa* is disposed, so as to be along in the lengthwise direction of the flap body 80, on the front surface 80*x* of the flap body 80 in a section in the neighborhood of the outside end portion in a state where the front surface 80*x* is mainly facing the blow-out airflow downstream side. Outside the section where the concavo-convexly shaped portion 80*xa* is disposed, the front surface 80*x* of the flap body 80 is configured by a smooth, substantially flat surface. Further, a flocked sheet 80*ya* comprising a sheet in which a mixture of short fibers with different pile lengths is uniformly flocked is adhered to the back surface 80*y* of the flap body 80. The flocked sheet 80*ya* is a section that the conditioned air from inside the casing body 31*a* strikes when adjusting the blow-out airflow direction in a state where the front surface 80*x* of the flap body 80 is mainly facing the blow-out airflow downstream side. The flocked sheet 80*ya* can suppress the formation of dew condensation on the flap body 80. As shown in FIG. 10, the flocked sheet 80*ya* is disposed slightly toward the inside in astute where the front surface 80*x* is mainly facing the blow-out airflow downstream side. The flocked sheet 80*ya* is disposed in such a way that there becomes less of a section in which the flocked sheet 80*ya* and the concavo-convexly shaped portion 80*xa* overlap in the plate thickness direction of the flap body 80.

Further, as shown in FIG. 9, which is an external perspective view seen from the front surface 80*x* side, the outer edge shape of the flap body 80 includes a flap inside linear portion 80*a*, flap inside curved portions 80*b*, flap lengthwise direction end portions 80*c*, a flap outside linear portion 80*d*, and flap outside curved portions 80*e*. The flap inside linear portion 80*a* is positioned on the inside of the flap body 80 in a state where the front surface 80*x* of the flap body 80 is facing the room side. The flap inside linear portion 80*a* is the edge of a linearly shaped section extending substantially parallel to the rotating shaft 90*x* direction. The flap inside linear portion 80*a* is disposed in the neighborhood of the center of the flap body 80 in the direction of the rotating shaft 90*x* and occupies a section of about 50% of the flap body 80 in the lengthwise direction. The flap inside curved portions 80*b* are edges that gently connect the flap lengthwise direction end portions 80*c* to both ends of the flap inside linear portion 80*a* and have shapes gently bulging toward the outside of the flap body 80. The flap inside curved portions 80*b* occupy sections of about 25% each from the lengthwise direction end portions of the flap body 80. The flap lengthwise direction end portions 80*c* are placed in positions toward the flap outside linear portion 80*d* in the width direction orthogonal to the rotating shaft 90*x* direction, that is, in a direction orthogonal to both the flap inside linear portion 80*a* and the flap outside linear portion 80*d*. In other words, in a case where the flap body 80 is seen from the front surface 80*x* side, the flap lengthwise direction end portions 80*c* are disposed in such a way that the width direction distance between the flap lengthwise direction end portions 80*c* and the flap inside linear portion 80*a* is longer than the width direction distance between the flap lengthwise direction end portions 80*c* and the flap outside linear portion 80*d*. The flap outside linear portion 80*d* is positioned on the outside of the flap body 80 in a state where the front surface 80*x* of the flap body 80 is facing the room side. The flap outside linear portion 80*d* is the edge of a linearly shaped section extending substantially parallel to the rotating shaft 90*x* direction. The flap outside linear portion 80*d* is also disposed in the neighborhood of the center of flap body 80 in the direction of the rotating shaft 90*x* but is formed shorter than the length of the flap inside linear portion 80*a*. The flap outside curved portions 80*e* are edges that connect, more abruptly than the flap inside curved portions 80*b*, the flap lengthwise direction end portions 80*c* to both ends of the flap outside linear portion 80*d* and have shapes bulging gently outward.

As shown in FIG. 10, the arm 90 extends as far as a section beyond the rotating shaft 90*x* in a direction away from the back surface 80*y* of the flap body 80 in the neighborhoods of both lengthwise direction end portions of the flap body 80. That is, as shown in FIG. 10, the length of the arm 90 is formed longer than a distance D from the back surface 80*y* of the flap body 80 to the rotating shaft 90*x*. The arm 90 extends in such a way that it inclines a little more toward the outer frame decorative panel 38 side than in the plate thickness direction of the flap body 80 in a state where the majority of the front surface 80*x* of the flap body 80 can be seen when the casing body 31*a* is seen from below. As shown in FIG. 9, shaft members 90*a* that extend so as to follow the rotating shafts 90*x* are disposed in the neighborhoods of the end portions of the arms 90 on the opposite sides of the end portions on the flap body 80 side. The arm 90 extends from a little lower side of the back surface 80*y* of the flap body 80 in a state where the front surface 80*x* of the flap body 80 is facing the room side and has a width that is about 30% of the width, in the neighborhood of the center, of the flap body 80.

The placement relationship between the long-side air outlets 50 and the airflow direction adjusting portions 70 will be described later.

The indoor fan 41 is a centrifugal blower placed inside the casing body 31*a*. The indoor fan 41 forms an airflow that sucks the room air through the air inlet 35 in the decorative panel 32 into the casing body 31*a* and blows out the air through the air outlet 36 in the decorative panel 32 to the outside of the casing body 31*a*. The indoor fan 41 has a fan motor 41*a* that is disposed in the center of the top plate 33*a* of the casing body 31*a* and an impeller 41*b* that is coupled to and driven to rotate by the fan motor 41*a*. The impeller 41*b* is an impeller having turbo blades and can suck air into the inside of the impeller 41*b* from below and blow out the air toward the outer peripheral side of the impeller 41*b* as seen from above.

The indoor heat exchanger 42 is a fin-and-tube heat exchanger that is bent so as to surround the periphery of the indoor fan 41 as seen from above and is placed inside the casing body 31*a*. More specifically, the indoor heat exchanger 42 is a fin-and-tube heat exchanger called a cross-fin type that has numerous heat transfer fins placed a predetermined interval apart from each other and plural heat transfer tubes disposed in a state where they penetrate these heat transfer fins in their plate thickness direction. As described above, the liquid side of the indoor heat exchanger 42 is connected to the liquid refrigerant connection tube 5 via the liquid-side connecting tube 5*a*. The gas side of the indoor heat exchanger 42 is connected to the gas refrigerant connection tube 6 via the gas-side connecting tube 6*a*. Additionally, the indoor heat exchanger 42 functions as an evaporator of the refrigerant during cooling and as a condenser of the refrigerant during heating. Because of this, the indoor heat exchanger 42 can perform heat exchange with the air that has been blown out from the indoor fan 41, cool the air during cooling, and heat the air during heating.

The drain pan 40 is placed on the underside of the indoor heat exchanger 42 and receives drain water produced as a result of moisture in the air condensing in the indoor heat exchanger 42. The drain pan 40 is attached to the lower portion of the casing body 31*a*. Outlet holes 40*a*, an inlet hole 40*b*, and a drain water receiving channel 40*c* are formed in the drain pan 40. The outlet holes 40*a* are formed in various places so as to be communicated with the air outlet 36 in the decorative panel 32. The inlet hole 40*b* is formed so as to be communicated with the air inlet 35 in the decorative panel 32. The drain water receiving channel 40*c* is formed on the underside of the indoor heat exchanger 42.

The bell mouth 41*c* is placed so as to correspond to the inside of the inlet hole 40*b* in the drain pan 40 and guides the air sucked in from the air inlet 35 to the impeller 41*b* of the indoor fan.

<1-3> Control Unit 7

As shown in FIG. 1, a control unit 7 has an outdoor control unit 7*a* that controls the various configural devices of the outdoor unit 2, an indoor control unit 7*b* that controls the various configural devices of the indoor unit 4, and a controller 7*c* for receiving setting inputs from a user.

The control unit 7 performs: independent airflow direction control that independently adjusts the airflow directions of the conditioned air blown out from four air outlets—the first long-side air outlet 51, the second long-side air outlet 52, the third long-side air outlet 53, and the fourth long-side air outlet 54—of the air outlet 36 by performing control that allows the first airflow direction adjusting portion 71, the second airflow direction adjusting portion 72, the third airflow direction adjusting portion 73, and the fourth airflow direction adjusting portion 74 to be moved independently, per each airflow direction adjusting portion 70, to thereby change their rotational states; and interlocking airflow direction control that interlockingly adjusts the aforementioned airflow direction by performing control that causes all of the first airflow direction adjusting portion 71, the second airflow direction adjusting portion 72, the third airflow direction adjusting portion 73, and the fourth airflow direction adjusting portion 74 to move interlockingly so that their postures have the same rotational state. Here, the controller 7*c* has an input button and other components and receives from the user an instruction to either perform the independent airflow direction control or perform the interlocking airflow direction control. Additionally, the control unit 7 performs the independent airflow direction control or the interlocking airflow direction control in accordance with the instruction to perform the independent airflow direction control or the interlocking airflow direction control that the controller 7*c* has received.

In addition to the independent airflow direction control and the interlocking airflow direction control, the control unit 7 also performs, in regard to the four air outlets—the first long-side air outlet 51, the second long-side air outlet 52, the third long-side air outlet 53, and the fourth long-side air outlet 54—of the air outlet 36, individual air volume suppression control that most reduces the volume of air blown out from a specific long-side air outlet 51 to 54 by individually independently adjusting the rotational state of each of the airflow direction adjusting portions 70 including the first airflow direction adjusting portion 71, the second airflow direction adjusting portion 72, the third airflow direction adjusting portion 73, and the fourth airflow direction adjusting portion 74 to change the posture. Here, the controller 7*c* can, like described above, receive from the user an instruction to perform the individual air volume suppression control and a designation of a specific long-side air outlet 50 of the long-side air outlets 50 selected to have the volume of air blown out from that long-side air outlet suppressed. Additionally, in a case where the controller 7*c* has received an instruction to perform the individual air volume suppression control, the control unit 7 performs the individual air volume suppression control by rotating the airflow direction adjusting portion 70 placed in the position of the specific long-side air outlet 50 in such a way that the volume of air blown out from the specific long-side air outlet 50 becomes most reduced. Here, the number of the long-side air outlets 50 whose air volumes can be suppressed by the individual air volume suppression control at the same time is two or less, and the control unit 7 prohibits the individual air volume suppression control from being performed at the same time in regard to three or more of the long-side air outlets 50. Specifically, the control unit 7 allows the individual air volume suppression control to be continued in regard to specific long-side air outlets 50 whose designation the control unit 7 has received first and second, and the control unit 7 ignores setting inputs of the individual air volume suppression control in regard to specific long-side air outlets 50 whose designation the controller 7*c* receives thereafter. In a case where the user cancels, from the controller 7*c*, the individual air volume suppression control in regard to a specific long-side air outlet 50, the control unit 7 can then perform the individual air volume suppression control in regard to another long-side air outlet 50.

<Basic Actions>

Next, the actions of the air conditioning apparatus 1 during a cooling operation and a heating operation will be described.

<2-1> Cooling Action

In the refrigerant circuit 10 during cooling, the four-way switching valve 22 is in the state indicated by the solid lines in FIG. 1. Further, the liquid-side stop valve 25 and the gas-side stop valve 26 are placed in an open state, and the opening degree of the expansion valve 24 is adjusted on as to reduce the pressure of the refrigerant.

In this state of the refrigerant circuit 10, low-pressure gas refrigerant is sucked into the compressor 21. In the compressor 21, the low-pressure gas refrigerant is compressed and becomes high-pressure gas refrigerant. The high-pressure gas refrigerant is discharged from the compressor 21. The high-pressure gas refrigerant is sent through the four-way switching valve 22 to the outdoor heat exchanger 23. In the outdoor heat exchanger 23, the high-pressure gas refrigerant performs heat exchange with the outdoor air, condenses, and becomes high-pressure liquid refrigerant. The high-pressure liquid refrigerant is sent to the expansion valve 24. In the expansion valve 24, the high-pressure liquid refrigerant has its pressure reduced and becomes low-pressure refrigerant in a gas-liquid two-phase state. The low-pressure refrigerant in the gas-liquid two-phase state is sent through the liquid-side stop valve 25, the liquid refrigerant connection tube 5, and the liquid-side connecting tube 5*a* to the indoor heat exchanger 42. In the indoor heat exchanger 42, the low-pressure refrigerant in the gas-liquid two-phase state performs heat exchange with the air blown out from the indoor fan 41, evaporates, and becomes low-pressure gas refrigerant. The low-pressure gas refrigerant is sent back to the compressor 21 through the gas-side connecting tube 6*a*, the gas refrigerant connection tube 6, the gas-side stop valve 26, and the four-way switching valve 22.

<2-2> Heating Action

Next, in the refrigerant circuit 10 during heating, the four-way switching valve 22 is in the state indicated by the broken lines in FIG. 1. Further, the liquid-side stop valve 25 and the gas-side stop valve 26 are placed in an open state, and the opening degree of the expansion valve 24 is adjusted in such a way that the expansion valve 24 reduces the pressure of the refrigerant.

In this state of the refrigerant circuit 10, low-pressure gas refrigerant is sucked into the compressor 21. In the compressor 21, the low-pressure gas refrigerant is compressed and becomes high-pressure gas refrigerant. The high-pressure gas refrigerant is discharged from the compressor 21. The high-pressure gas refrigerant is sent to the indoor heat exchanger 42 through the four-way switching valve 22, the gas-side stop valve 26, the gas refrigerant connection tube 6, and the gas-side connecting tube 6*a*. In the indoor heat exchanger 42, the high-pressure gas refrigerant performs heat exchange with the air blown out from the indoor fan 41, condenses, and becomes high-pressure liquid refrigerant. The high-pressure liquid refrigerant is sent through the liquid-side connecting tube 5*a*, the liquid refrigerant connection tube 5, and the liquid-side stop valve 25 to the expansion valve 24. In the expansion valve 24, the high-pressure liquid refrigerant has its pressure reduced and becomes low-pressure refrigerant in a gas-liquid two-phase state. The low-pressure refrigerant in the gas-liquid two-phase state is sent to the outdoor heat exchanger 23. In the outdoor heat exchanger 23, the low-pressure refrigerant in the gas-liquid two-phase state performs heat exchange with the outdoor air, evaporates, and becomes low-pressure gas refrigerant. The low-pressure gas refrigerant is sent through the four-way switching valve 22 back to the compressor 21.

<3> Placement Relationship Between Long-Side Air Outlets 50 and Airflow Direction Adjusting Portions 70

Here, the placement of the first airflow direction adjusting portion 71 in the neighborhood of the first long-side air outlet 51 will be described. The neighborhood of the second tong-side air outlet 52, the neighborhood of the third long-side air outlet 53, and the neighborhood of the fourth long-side air outlet 54 are the same as the neighborhood of the first long-side air outlet 51, so description thereof will be omitted.

<3-1> Placement Relationship as Seen from Below

Figure 11:
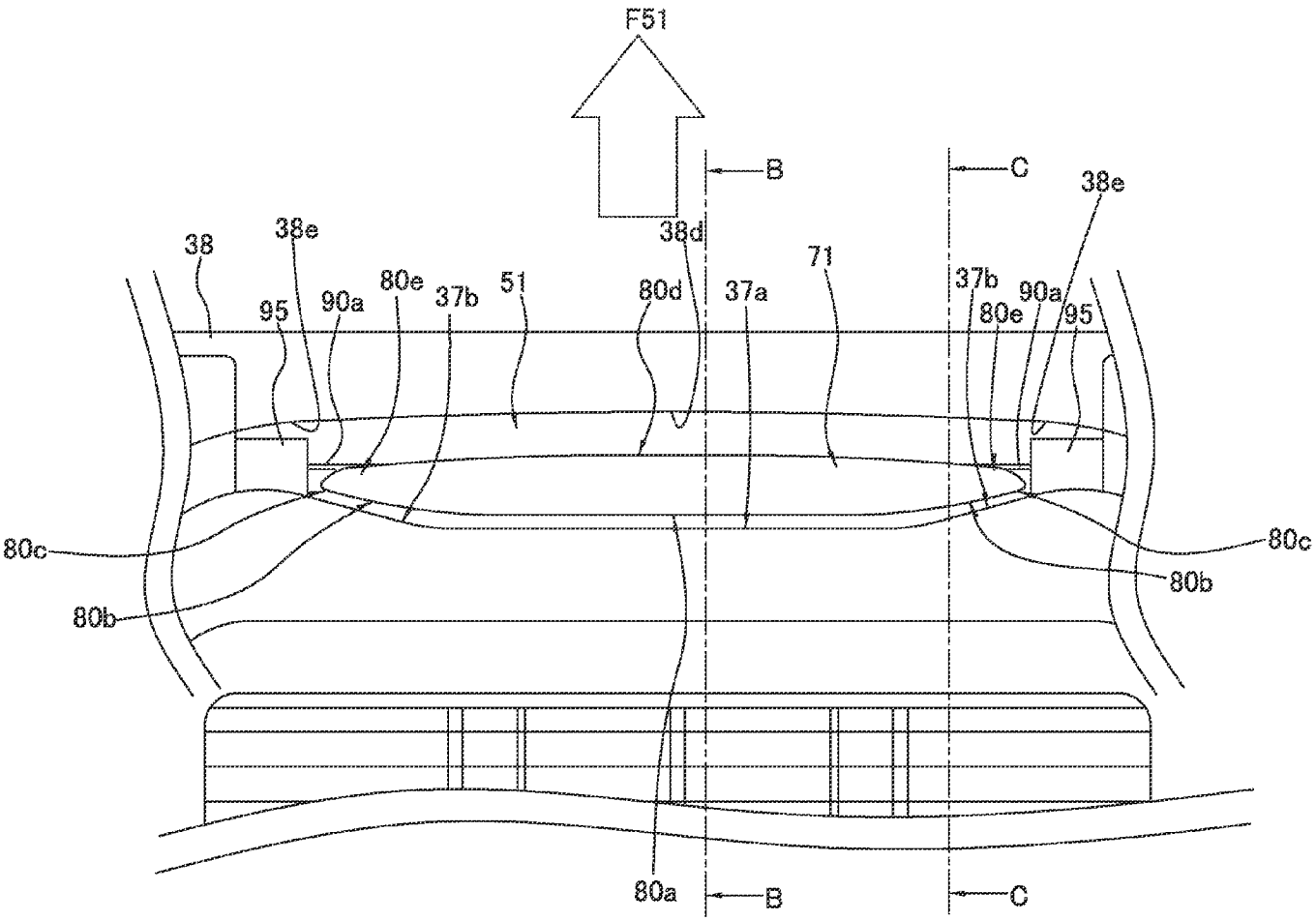
FIG. 11 is a partially enlarged external view, as seen from below, of the neighborhood of a first long-side air outlet.

FIG. 11 is a partially enlarged external view, as seen from below, of the neighborhood of the first long-side air outlet 51.

When the indoor unit 4 is seen from below, the first airflow direction adjusting portion 71 and airflow direction adjusting drive units 95 are placed on the inside of the first long-side air outlet 51.

The airflow direction adjusting drive units 95 are disposed on the insides of both lengthwise direction ends of the first long-side air outlet 51 and on the outsides of both lengthwise direction ends of the first airflow direction adjusting portion 71. The airflow direction adjusting drive units 95 are connected to the first airflow direction adjusting portion 71 via the shaft members 90*a* extending so as to follow the rotating shafts 90*x* from the arms 90 of the first airflow direction adjusting portion 71 and apply a driving force for causing the first airflow direction adjusting portion 71 to rotate. Specifically, the airflow direction adjusting drive units 95 and the shaft members 90*a* of the first airflow direction adjusting portion 71 configure unillustrated cam mechanisms, and drive control via the cam mechanisms is performed as a result of the control unit 7 sending to the airflow direction adjusting drive units 95 a control signal for causing the airflow direction adjusting drive units 95 to control the drive state of the first airflow direction adjusting portion 71.

The outside edge of the first long-side air outlet 51 is configured by the outer frame decorative panel 38, the inside edge of the first long-side air outlet 51 is configured by the inner frame decorative panel 37, and the lengthwise direction end portions of the first long-side air outlet 51 are configured by the inside side surfaces of the airflow direction adjusting drive units 95. The width, at the lengthwise direction end portions (the inside side surfaces of the airflow direction adjusting drive units 95), of the first long-side air outlet 51 is formed so as to be about 60% of the width, in the neighborhood of the lengthwise direction center, of the first long-side air outlet 51. Specifically, the outside edge of the first long-side air outlet 51 is configured by the outer frame air outlet-side linear portion 38*d* and the outer frame air outlet-side curved portions 38*e* of the outer frame decorative panel 38. Further, the inside edge of the first long-side air outlet 51 is configured by the inner frame air outlet-side linear portion 37*a* and the inner frame air outlet-side curved portions 37*b* of the inner frame decorative panel 37. Because of this, the first long-side air outlet 51 has, when seen from below, a shape that bulges greatly inward while bulging a little outward. The bulging of the first long-side air outlet 51 inward is formed so as to be greater than the bulging of the first long-side air outlet 51 outward.

The outer frame air outlet-side linear portion 38*d* of the outer frame decorative panel 38 is positioned in the neighborhood of the lengthwise direction center of the first long-side air outlet 51. The outer frame air outlet-side curved portions 38*e* of the outer frame decorative panel 38 are positioned in the neighborhoods of both lengthwise direction ends of the first long-side air outlet 51 and in the neighborhoods of the outsides of the airflow direction adjusting drive units 95.

The inner frame air outlet-side linear portion 37*a* of the inner frame decorative panel 37 is positioned in the neighborhood of the lengthwise direction center of the first long-side air outlet 51. The inner frame air outlet-side curved portions 37*b* of the inner frame decorative panel 37 are positioned a little inside of both lengthwise direction ends of the first long-side air outlet 51 and on the insides of the airflow direction adjusting drive units 95 and in the neighborhoods between the airflow direction adjusting drive units 95 and the first airflow direction adjusting portion 71.

The horizontal direction width between the flap outside linear portion 80*d* and the flap outside curved portions 80*e* configuring the outside edge of the flap body 80 of the first airflow direction adjusting portion 71 and the outer frame air outlet-side linear portion 38*d* and the outer frame air outlet-side curved portions 38*e* of the outer frame decorative panel 38 configuring the outside edge of the first long-side air outlet 51 is placed so as to be substantially the same width (about 2 cm) across in the entire lengthwise direction of the first long-side air outlet 51.

The horizontal direction width between of the flap inside linear portion 80*a*, the flap inside curved portions 80*b*, and the flap lengthwise direction end portions 80*c* configuring the inside edge of the flap body 80 of the first airflow direction adjusting portion 71 and the inner frame air outlet-side linear portion 37*a* and the inner frame air outlet-side curved portions 37*b* of the outer frame decorative panel 38 configuring the inside edge of the first long-side air outlet 51 is placed so as to be substantially the same width (about 1 cm) across in the entire lengthwise direction of the first long-side air outlet 51 so that the mutual edges follow each other.

The width between the inside edge of the flap body 80 of the first airflow direction adjusting portion 71 and the inside edge of the first long-side air outlet 51 is configured to be equal to or less than half of the width between the outside edge of the flap body 80 of the first airflow direction adjusting portion 71 and the outside edge of the first long-side air outlet 51.

<3-2> Placement Relationship in Neighborhood of Center of Airflow Direction Adjusting Portions 70

Figure 12:
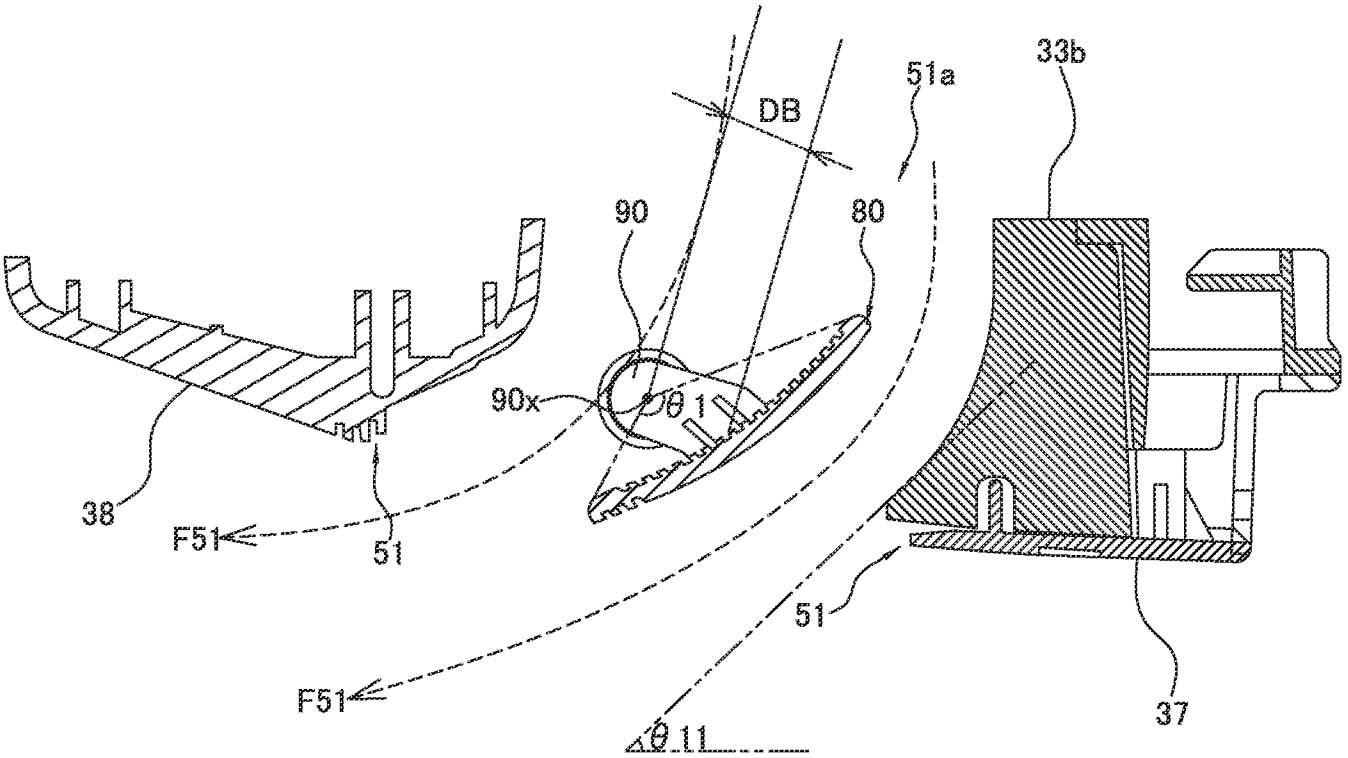
FIG. 12 is a schematic cross-sectional view showing, in the neighborhood of the first long-side air outlet in cross section B-B in FIG. 11, an example of a postural state of the airflow direction adjusting portion during independent airflow direction control or interlocking airflow direction control.

FIG. 12 is a schematic cross-sectional view, in cross section B-B in FIG. 11, in the neighborhood of the first long-side air outlet 51. The posture of the airflow direction adjusting portion 70 shown in FIG. 12 is an example of the posture of the flap body 80 in a case where the independent airflow direction control or the interlocking airflow direction control is being performed.

As shown in FIG. 12, the first long-side air outlet flow path 51*a* extends toward the airflow upstream side from the first tong-side air outlet 51. The inside wall surface of the first long-side air outlet flow path 51*a* in the neighborhood of the first long-side air outlet 51 is configured by the bottom plate 33*b* of the casing body 31*a*. In the neighborhood of the lengthwise direction center of the flap body 80, the inside wall surface of the first long-side air outlet flow path 51*a* has, as shown in FIG. 12, a shape curved in such a way that the center of its radius of curvature is positioned on the rotating shaft 90*x* side, and the inside wall surface of the first long-side air outlet flow path 51*a* is formed so as to be positioned further outside closer to the first long-side air outlet 51. In the neighborhood of the lengthwise direction center of the flap body 80, the outside wall surface of the first long-side air outlet flow path 51*a* has, as shown in FIG. 12, a shape curved in such a way that the center of its radius of curvature is positioned on the opposite side of the rotating shaft 90*x* side so that the distance between the outside wall surface and the inside wall surface is maintained, and the outside wall surface of the first long-side air outlet flow path 51*a* is formed so as to be positioned further outside closer to the first tong-side air outlet 51. The neighborhood of the center of the first long-side air outlet flow path 51*a* is inclined in such a way that an angle of inclination θ11 of the inside wall surface and the outside wall surface in the section of the first long-side air outlet 51 in the blow-out direction end portion is about 40° with respect to the horizontal direction, so that the blown-out air can be guided more outward.

The rotating shaft 90*x* is positioned on the airflow direction upstream side of the first long-side air outlet 51 positioned in the end portion of the first long-side air outlet flow path 51*a*. Further, the rotating shaft 90*x* is placed so as to be closer to the outside wall surface side of the first long-side air outlet flow path 51*a* than the inside wall surface side of the first long-side air outlet flow path 51*a*.

The arm 90 is positioned in a position substantially coinciding with, or on the airflow upstream side of, the first tong-side air outlet 51 positioned in the end portion of the first long-side air outlet flow path 51*a* even in the rotational state closest to the first long-side air outlet 51 of the rotational states of the first airflow direction adjusting portion 71.

As shown in FIG. 12, the width direction length, in the neighborhood of the center, of the flap body 80 is disposed in such a way that an angle θ1 formed by a line joining together the rotating shaft 90*x* and one width direction end side of the flap body 80 and a line joining together the rotating shaft 90*x* and the width direction other end side of the flap body 80 is about 135°.

When the independent airflow direction control or the interlocking airflow direction control is being performed, the flap body 80 of the airflow direction adjusting portion 70 is swung by the airflow direction adjusting drive units 95 in the range of about +30° and about −30° taking as a reference a state where the angle of inclination of the section, in the neighborhood of the center, of the front surface 80*x* is about 30° (corresponding to FIG. 12).

<3-3> Placement Relationship in Neighborhoods of End Portions of Airflow Direction Adjusting Portions 70

Figure 13:
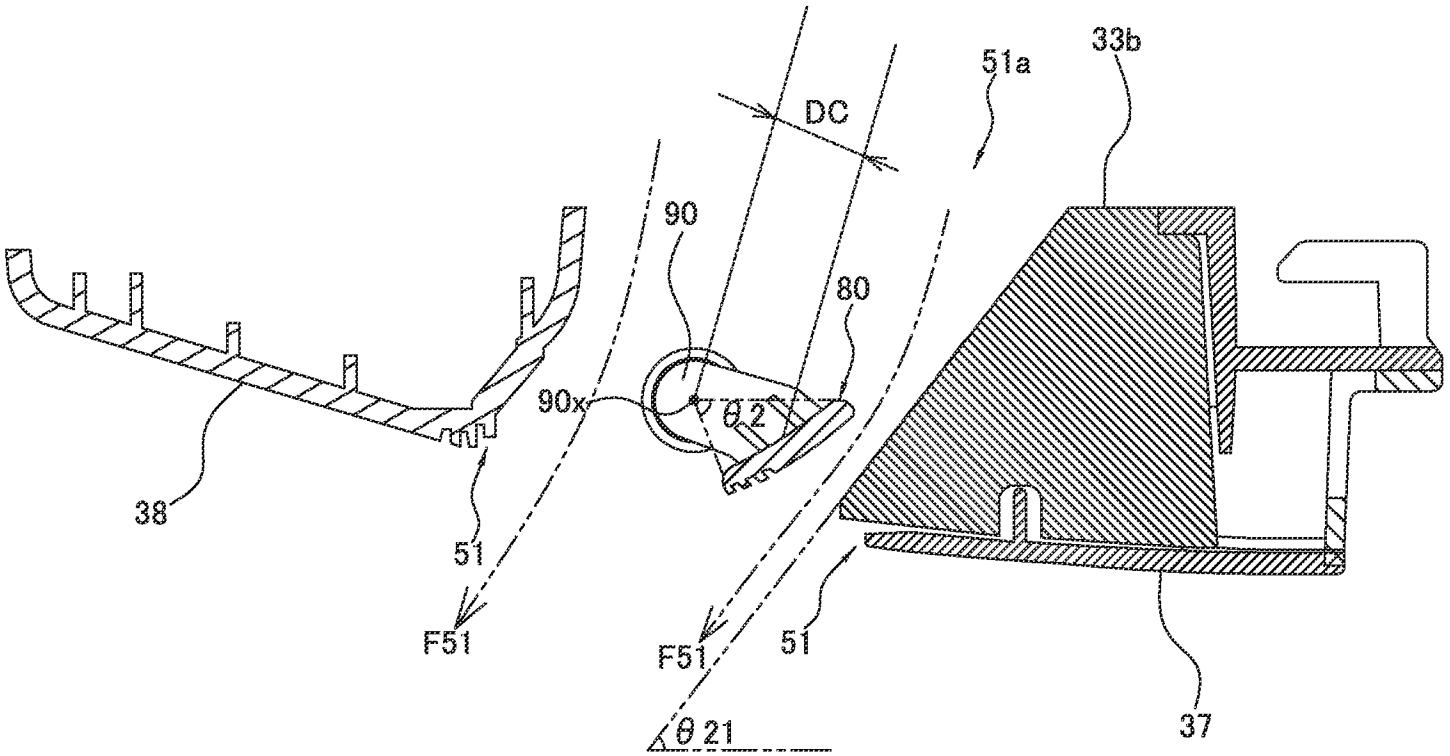
FIG. 13 is a schematic cross-sectional view showing, in the neighborhood of the first long-side air outlet in cross section C-C in FIG. 11, an example of a postural state of the airflow direction adjusting portion during the independent airflow direction control or the interlocking airflow direction control.

FIG. 13 is a schematic cross-sectional view, in cross section C-C in FIG. 11, in the neighborhood of the first long-side air outlet 51.

In the neighborhoods of the lengthwise direction end portions of the flap body 80, the inside wall surface of the first long-side air outlet flow path 51*a* has, as shown in FIG. 13, a planar shape formed so as to be positioned further outside closer to the first long-side air outlet 51, so that the shape differs from the curved shape in the neighborhood of the center. Further, in the neighborhoods of the lengthwise direction end portions of the flap body 80, the outside wall surface of the first long-side air outlet flow path 51*a* is like the inside wall surface and has, as shown in FIG. 13, a planar shape firmed so as to be positioned further outside closer to the first long-side air outlet 51, so that the shape differs from the curved shape in the neighborhood of the center. The shapes of the inside wall surface and the outside wall surface of the first long-side air outlet flow path 51*a* are formed in such a way that the shape in the neighborhood of the lengthwise direction center of the flap body 80 and the shape in the neighborhoods of the lengthwise direction end portions of the flap body 80 change gradually in accordance with the lengthwise direction position of the flap body 80. The neighborhood of the end portion of the first tong-side air outlet flow path 51*a* is inclined in such a way that an angle of inclination θ21 of the inside wall surface and the outside wall surface in the section of the first long-side air outlet 51 in the blow-out direction end portion is about 55° with respect to the horizontal direction, so that the blown-out air can be guided more downward.

The width direction length, in the neighborhoods of the end portions, of the flap body 80 is disposed in such a way that, as shown in FIG. 13, an angle θ2 formed by a line joining together the rotating shaft 90*x* and one width direction end side of the flap body 80 and a line joining together the rotating shaft 90*x* and the other width direction end side of the flap body 80 is about 75°. In other words, the width direction length, in the neighborhoods of the end portions, of the flap body 80 is configured so as to be about 40% of the width direction length, in the neighborhood of the center, of the flap body 80.

<4> Placement Relationship Between Long-Side Air Outlets 50 and Airflow Direction Adjusting Portions 70 During Shutdown When the controller 7*c* receives from the user an instruction to shut down (a state where the cooling action and the heating action are not performed), the control unit 7 sends a control signal to the airflow direction adjusting drive units 95 to cause all of the airflow direction adjusting portions 70—that is, all of the first airflow direction adjusting portion 71, the second airflow direction adjusting portion 72, the third airflow direction adjusting portion 73, and the fourth airflow direction adjusting portion 74—to rotate, whereby the airflow direction adjusting portions 70 are adjusted so that the centers of their front surfaces 80*x* face substantially vertically downward.

Because of this, during shutdown, when the indoor unit 4 is seen from below, the insides of the tong-side air outlets 50 appear most covered by the airflow direction adjusting portions 70, so that the sense of unity between the decorative panel 32 and the airflow direction adjusting portions 70 can be improved. Because of this, the design of the indoor unit 4 during shutdown can be improved, and the user can easily know that the indoor unit 4 is in a shutdown state.

Figure 14:
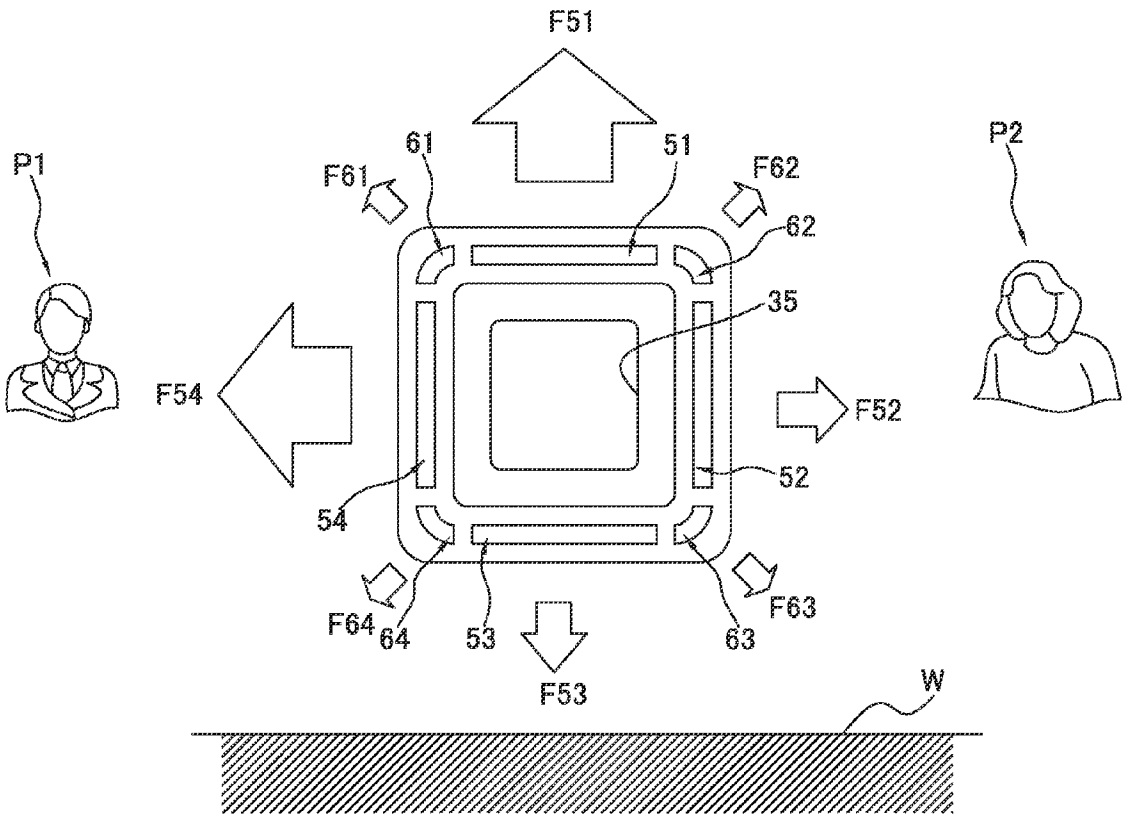
FIG. 14 is a conceptual diagram of air volume suppression control.

<5> Placement Relationship Between Long-Side Air Outlets 50 and Airflow Direction Adjusting Portions 70 During Individual Air Volume Suppression Control FIG. 14 is a conceptual diagram of the air volume suppression control.

When the controller 7*c* receives from the user an instruction to suppress the volume of air blown out from a specific long-side air outlet 50, the control unit 7 sends a control signal to the airflow direction adjusting drive units 95, of the airflow direction adjusting drive units 95, that control the rotational state of the airflow direction adjusting portion 70 disposed in the position corresponding to the specific long-side air outlet 50 instructed by the user. Because of this, the airflow direction adjusting drive units 95 that have received the control signal cause the airflow direction adjusting portion 70 whose rotational state they themselves control to rotate, to thereby adjust the airflow direction adjusting portion 70 to a posture that restricts the volume of air blown out from the long-side air outlet 50 specified by the user. For example, as shown in FIG. 14, in a case where the indoor unit 4 is placed near a wall surface W a room and near a user P1 and a user P2, when the controller 7*c* receives an instruction to suppress the volume of air blown out toward the user P2, the control unit 7 performs the individual air volume suppression control to reduce the volume of the airflow F53 blown out from the third long-side air outlet 53 toward the wall surface W and to also reduce the volume of the airflow F52 blown out from the second long-side air outlet 52 toward the user P2. Because of this, useless provision of conditioned air toward the wall surface W where there is no user can be reduced, and the air volume desired by the user P2 can be realized. For example, the instruction given by the user P2 may include a case where the user P2 wants to reduce the sensation of a draft or a case where the user P2 feels too cool or too warm due to cooling or heating.

Figure 15:
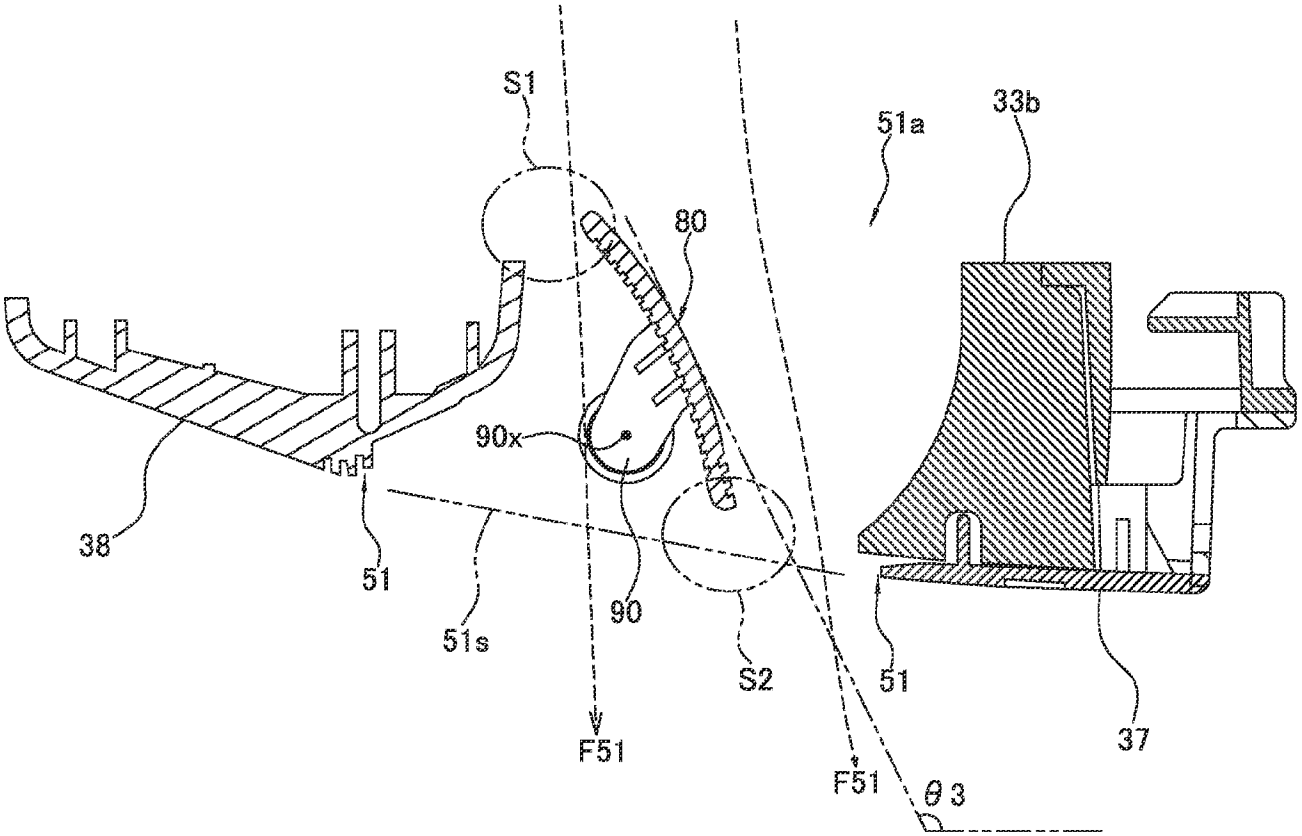
FIG. 15 is a schematic cross-sectional view showing, in the neighborhood of the first long-side air outlet in cross section B-B in FIG. 11, an example of a postural state of the airflow direction adjusting portion during the air volume suppression control.

FIG. 15 is a cross-sectional view, corresponding to cross section B-B in FIG. 11, showing an example of the inclined state of the airflow direction adjusting portion 70 during the individual air volume suppression control.

The flap body 80 on which the individual air volume suppression control is performed is adjusted by the airflow direction adjusting drive units 95 in such a way that the front surface 80*x* faces the airflow upstream side of the first long-side air outlet flow path 51*a*. Specifically, the flap body 80 is adjusted by the airflow direction adjusting drive units 95 in such a way that an angle of inclination θ3 (an inside angle) of the section, in the neighborhood of the center, of the front surface 80*x* with respect to a horizontal plane is about 110° (which corresponds to FIG. 15). Because of this, the volume of air blown out from the long-side air outlet 50 on which the individual air volume suppression control has been performed can be reduced. The angle of inclination during the individual air volume suppression control is finely adjusted in the range of +5° and −5° from the angle of about 110°.

In a state where the individual air volume suppression control has been performed, a gap of about 5 mm to 10 mm is ensured (in the section indicated by S1 in FIG. 15) between the wall surface of the first long-side air outlet flow path 51*a* on the outer frame decorative panel 38 side and the end portion on the upper side of the flap body 80, so that a little blow-out air flows through there.

Further, in a state where the individual air volume suppression control has been performed, the end portion on the lower side of the flap body 80 (the section indicated by S2 in FIG. 15) is positioned more on the airflow upstream side in the first long-side air outlet flow path 51*a* than the first long-side air outlet 51. Because of this, substantially the entire periphery of the flap body 80 can be enveloped by the conditioned air whose temperature has been adjusted inside the indoor unit 4, and it can be made difficult for the air in the room whose temperature has not been adjusted to touch the flap body 80. For this reason, even in a state where the volume of air blown out from the long-side air outlet 50 has been reduced by the individual air volume suppression control, it can be made difficult for the room air whose temperature has not been adjusted to reach the flap body 80, and the formation of dew condensation on the flap body 80 can be suppressed.

<6> Characteristics of Present Embodiment (1)

Figure 16:
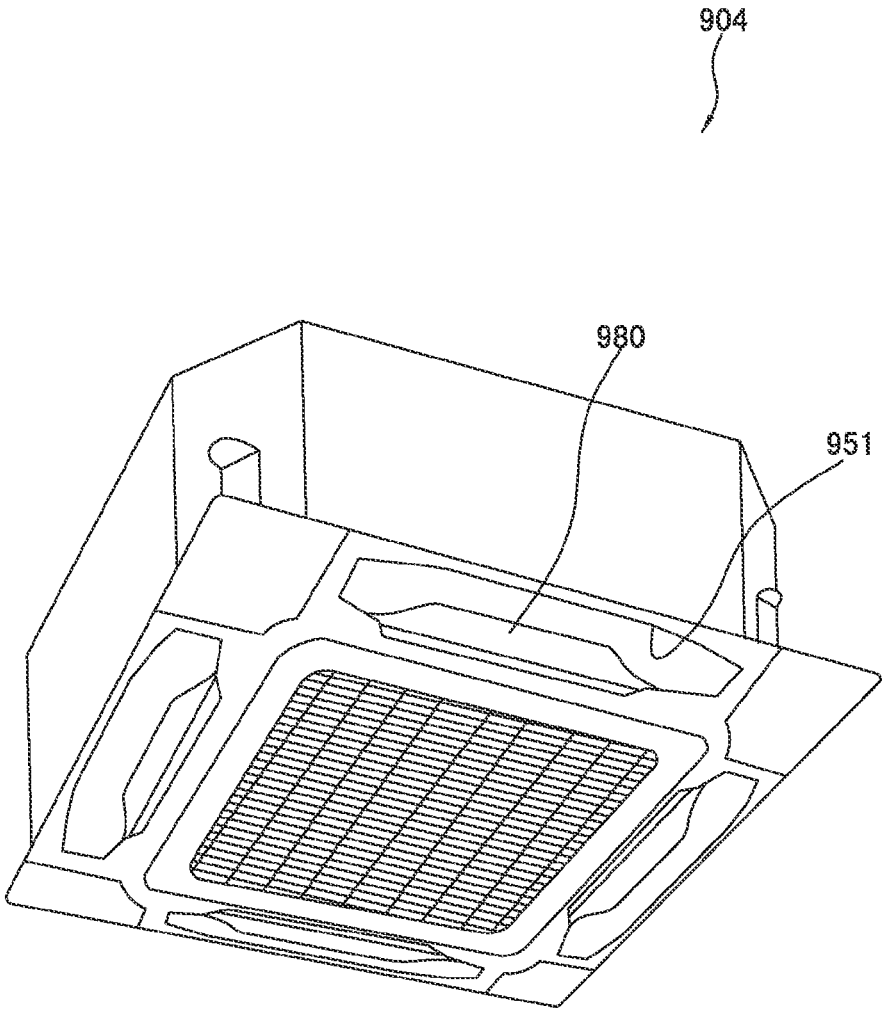
(PRIOR ART) FIG. 16
FIG. 16 is an external perspective view of an indoor unit of a conventional air conditioning apparatus.

In an indoor unit of a conventional air conditioning apparatus, for example, like in an indoor unit 904 shown in FIG. 16, air outlets 951 have quadrilateral shapes, and flap bodies 980 also have quadrilateral shapes so as to correspond to the air outlets. For this reason, large air resistances from the wall surfaces of the air outlets 951 end up acting on the airflows blown out from the neighborhoods of the centers of the air outlets 951.

With respect to this, in the indoor unit 4 of the air conditioning apparatus 1 of the present embodiment, the width of the sections in the lengthwise direction centers of the long-side air outlets 50 is formed so as to become larger. For this reason, the air flux of the airflows passing through and blown out from the neighborhoods of the centers of the long-side air outlets 50 can be increased to make it easier for the airflows to maintain their initial speed, and the blow distance of the conditioned air can be increased.

(2)

In the indoor unit 4 of the air conditioning apparatus 1 of the present embodiment, in the neighborhood of the center of the first long-side air outlet flow path 51*a* etc., the angle of inclination of the inside wall surface and the outside wall surface in the neighborhood of the air outlet with respect to a horizontal plane is configured to become smaller compared to the neighborhoods of the end portions of the first long-side air outlet flow path 51*a* etc. Because of this, the air blown out from the neighborhood of the center of the first long-side air outlet flow path 51*a* etc. can be caused to reach farther.

(3)

In a conventional type of indoor unit that is installed so as to be embedded in a ceiling and where the air outlet for the conditioned air and the ceiling surface are near each other, an airflow arises along the ceiling surface when the conditioned air is blown out in a substantially horizontal direction, and the ceiling surface easily becomes dirty along the airflow. Particular in the neighborhoods of both lengthwise direction end portions of the air outlet, airflow turbulence arises and the dirtiness becomes pronounced.

With respect to this, in the indoor unit 4 of the air conditioning apparatus 1 of the present embodiment, the flow direction of the air blown out from the neighborhood of the center of the first long-side air outlet flow path 51*a* etc. is a direction more along the ceiling U surface than the flow direction of the air blown out from the neighborhoods of the ends portions of the first long-side air outlet flow path 51*a* etc. However, as described above, the airflow blown out from the neighborhood of the center of the first long-side air outlet flow path 51*a* etc. has increased air flux and easily maintains its initial speed, so turbulence in the airflow in the vicinity of the ceiling surface in the vicinity of the neighborhood of the center of the first long-side air outlet 51 etc. can be reduced. Because of this, ceiling dirtying caused by the air blown out from the neighborhood of the center of the first long-side air outlet 51 etc. can be suppressed.

(4)

In the indoor unit 4 of the air conditioning apparatus 1 of the present embodiment, in the neighborhoods of the lengthwise direction end portions of the long-side air outlets 50, the width direction length is formed short compared to the neighborhood of the lengthwise direction center of the long-side air outlets 50, so the airflows are slow. In the sections where the airflow is slow in this way, the air tends to flow convectively along the surface of the ceiling U.

With respect to this, in the indoor unit 4 of the air conditioning apparatus 1 of the present embodiment, the angle of inclination of the wall surfaces, in the neighborhood of the outlet, in the neighborhoods of the lengthwise direction end portions of the first long-side air outlet flow path 51*a* etc. is formed so as to be steeper than the angle of inclination of the wall surfaces, in the vicinity of the outlet, in the neighborhood of the lengthwise direction center of the first long-side air outlet flow path 51*a* etc. Because of this, the conditioned air blown out from the neighborhoods of the lengthwise direction end portions of the long-side air outlets 50 can be guided in a direction more away from the surface of the ceiling U (more vertically downward) than the conditioned air blown out from the neighborhood of the lengthwise direction center of the long-side air outlets 50. Because of this, ceiling dirtying arising in the neighborhoods of the end portions of the long-side air outlets 50 can be suppressed.

(5)

In the indoor unit 4 of the air conditioning apparatus 1 of the present embodiment, as described above, an increase in the width direction distance in the neighborhood of the center of the long-side air outlets 50 for increasing the air flux of the airflow passing through and blown out from the neighborhood of the center of the long-side air outlets 50 to make it easier for the airflow to maintain its initial speed is realized as a result of the long-side air outlets 50 being formed bulging so as to become closer to the air inlet 35 side.

For this reason, an increase in the horizontal direction size of the indoor unit 4 of the air conditioning apparatus 1 can be suppressed compared to a case where the long-side air outlets 50 is formed so as to bulge outward.

(6)

In the indoor unit 4 of the air conditioning apparatus 1 of the present embodiment, the long-side air outlets 50 are formed so as to bulge inward, and the width between the inside edge of the flap body 80 of the first airflow direction adjusting portion 71 and the inside edge of the first long-side air outlet 51 is configured so as to be equal to or less than half of the width between the outside edge of the flap body 80 of the first airflow direction adjusting portion 71 and the outside edge of the first long-side air outlet 51.

For this reason, short-circuiting that can arise between the sucked-in air and the blown-out air in accompaniment with forming the long-side air outlets 50 so as to bulge inward can be suppressed.

(7)

In the indoor unit 4 of the air conditioning apparatus 1 of the present embodiment, the long-side air outlets 50 have a shape in which the speed of the blown-out air becomes smaller closer to the lengthwise direction end portions and which easily produces short-circuiting.

With respect to this, in the indoor unit 4 of the air conditioning apparatus 1 of the present embodiment, the long-side air outlets 50 are formed in such a way that their distance from the air inlet 35 increases toward the lengthwise direction end portions. For this reason, short-circuiting that can arise in the neighborhoods of the lengthwise direction end portions of the long-side air outlets 50 can be effectively suppressed.

(8)

Figure 17:
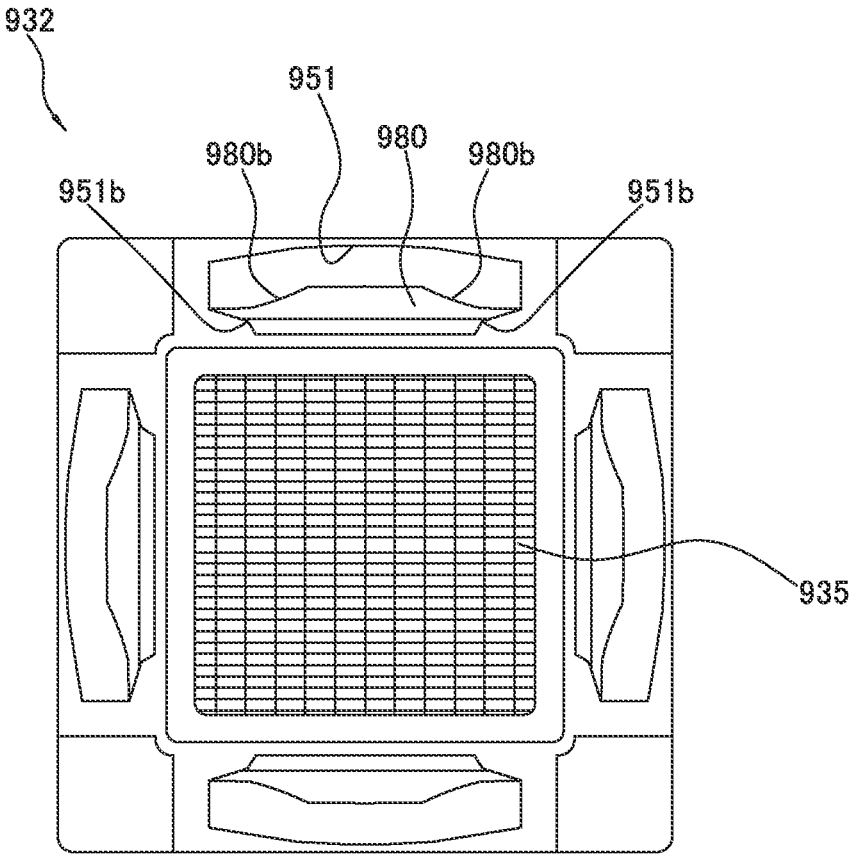
(PRIOR ART) FIG. 17
FIG. 17 is an external configuration view, as seen from below, of the indoor unit of the conventional air conditioning apparatus.

The indoor unit of the conventional air conditioning apparatus has an air inlet 935, air outlets 951, and flaps 980 when a decorative panel 932 is seen from below as shown in FIG. 17, for example. Each of the air outlets 951 has air outlet cutout portions 951*b* formed in such a way that the inside edge of the air outlet 951 is abruptly recessed. Each of the flaps 980 has flap cutout portions 980*b* formed in such a way that the outside edge of the flap 980 is abruptly recessed. In this case, the airflow becomes turbulent because the flow direction of the airflows in the flap cutout portions 980*b* and the flow direction of the airflow in the section outside the flap cutout portions 980*b* differ, and there are cases where dew condensation forms on the flap cutout sections 980*b* and in their vicinities and on the edge of the air outlet 951 in the neighborhoods thereof.

With respect to this, in the indoor unit 4 of the air conditioning apparatus 1 of the present embodiment, the flap bodies 80 of the airflow direction adjusting portions 70 are not given a shape where the air inlet 35 side is cut out in the neighborhoods of the lengthwise direction end portions; rather, the degree of bulging of the flap bodies 80 of the airflow direction adjusting portions 70 on the air inlet 35 side is raised so as to follow the shape of the long-side air outlets 50. For this reason, there is no abrupt change in the flow direction of the air, airflow turbulence can be suppressed, and the formation of dew condensation can be reduced.

(9)

Airflow adjusting flaps in conventional indoor units have not employed a configuration where the airflow adjusting flap covers the air outlet so as to follow the edge of the air outlet even during shutdown, so the user in the room has been able to see the inside of the indoor unit through uneven gaps or the like between the air outlet and the airflow adjusting flap, and the design of the airflow adjusting flap has been poor.

With respect to this, in the indoor unit 4 of the air conditioning apparatus 1 of the present embodiment, during shutdown, the widest area of the insides of the long-side air outlets 50 are covered by the airflow adjusting portions 70 when the indoor unit 4 is seen from below, and it is difficult for the user in the room to be able to see the inside of the indoor unit 4. Moreover, the outer edges of the flap bodies 80 have a shape following the edges of the long-side air outlets 50, and the sense of unity between the decorative panel 32 and the airflow direction adjusting portions 70 can be improved. Because of this, the design of the indoor unit 4 during shutdown can be improved.

(10)

In the indoor unit 4 of the air conditioning apparatus 1 of the present embodiment, the long-side air outlets 50 and the short-side air outlets 60 are alternately arranged and placed so as to surround the air inlet 35. Because of this, the conditioned air can be provided thoroughly around the indoor unit 4.

Compared to a type of indoor unit where only the long-side air outlets 50 are disposed and where the short-side air outlets 60 are not disposed, by disposing the short-side air outlets 60, the total area and the number of places where the conditioned air is blown out become larger, and there is the concern that the initial speed of the conditioned air passing through the long-side air outlets 50 in which the airflow direction adjusting portions 70 are disposed will end up dropping.

However, even in this case, in the indoor unit 4 of the air conditioning apparatus 1 of the present embodiment, by employing, in regard to the shape of the long-side air outlets 50, a shape where the width in the neighborhood of the center bulges, the extent to which the initial speed of the conditioned air from the long-side air outlets 50 drops can be kept small.

<7> Other Embodiments (A)

In the above embodiment, a case where the width, at the lengthwise direction end portions, of the first long-side air outlet 51 etc. is formed so as to be about 60% of the width, in the neighborhood of the lengthwise direction center, of the first long-side air outlet 51 etc. was taken as an example and described.

However, the present invention is not limited to this; provided that the width is 40% to 80%, for example, effects preferred from the standpoints of design and suppressing short-circuiting can be obtained.

(B)

In the above embodiment, a case where the width direction length, in the neighborhoods of the end portions, of the flap body 80 is configured to be about 40% of the width direction length, in the neighborhood of the center, of the flap body 80 was taken as an example and described.

However, the present invention is not limited to this; provided that the width is 20% to 60%, for example, effects preferred from the standpoints of design and suppressing short-circuiting can be obtained.

(C)

In the above embodiment, the indoor unit 4 that blows out conditioned air in eight directions was taken as an example and described.

However, the present invention is not limited to the above embodiment and may also have a configuration where, for example, in the above embodiment, the short-side air outlets 60 are not disposed and the blow-out directions are only those of the four long-side air outlets 50. The other embodiment may have the two long-side air outlets.

INDUSTRIAL APPLICABILITY

The present invention can increase the blow distance of the conditioned air blown out from the air outlet while suppressing short-circuiting and an increase in the size of the lower surface of the indoor unit, so the present invention is particularly useful in an indoor unit of air conditioning apparatus.

What is claimed is:

1. An indoor unit of an air conditioning apparatus, the indoor unit comprising:

an indoor unit casing having an air inlet and an air outlet, the air outlet having an edge on an air inlet side forming a bulge toward the air inlet; and an airflow direction adjusting member covering at least part of the air outlet, the airflow direction adjusting member having an edge on the air inlet side forming a bulge toward the air inlet, the air outlet being formed such that an inclination of edge surfaces of the air outlet in the neighborhoods of the lengthwise direction end portions with respect to a horizontal plane is steeper than an inclination of an edge surface of the air outlet in a lengthwise direction center at the downstream most end of the air outlet with respect to the horizontal plane, the air outlet being formed such that a degree of curvature of edge surfaces on the air inlet side in the neighborhood of the lengthwise direction center is higher than a degree of curvature of edge surfaces on the air inlet side in the lengthwise direction end portions, a direction of airflow blown out from neighborhood of the lengthwise direction end portions of the air outlet being directed more downward than a direction of an airflow blown out from the lengthwise direction center of the air outlet, and the indoor unit being a ceiling-embedded type.

2. The indoor unit of an air conditioning apparatus according to claim 1, wherein the air outlet is formed such that, in the neighborhoods of the lengthwise direction end portions, a width direction length of the air outlet becomes shorter towards the end portions in order to form the bulge of the air outlet, and the airflow direction adjusting member is formed such that, in the neighborhoods of the lengthwise direction end portions, a width direction length of the airflow direction adjusting member becomes shorter toward the end portions in order to form the bulge of the airflow direction adjusting member.

3. The indoor unit of an air conditioning apparatus according to claim 2, wherein the width direction length, at the lengthwise direction end portions, of the air outlet is 40 to 80% of the width direction length at the lengthwise direction center of the air outlet, the air outlet has a linearly shaped section that interconnects sections of the bulge in the neighborhoods of the lengthwise direction end portions, the width direction length, at the lengthwise direction end portions, of the airflow direction adjusting member is 20 to 60% of the width direction length at a lengthwise direction center of the airflow direction adjusting member, and the airflow direction adjusting member has a linearly shaped section that interconnects sections of the bulge in the neighborhoods of the lengthwise direction end portions.

4. The indoor unit of an air conditioning apparatus according to claim 2, wherein a degree of bulging of the air outlet toward the air inlet is at least greater than a degree of bulging of the air outlet toward an opposite side relative to the air inlet, and a degree of bulging of the airflow direction adjusting member toward the air inlet is at least greater than a degree of bulging of the airflow direction adjusting member toward an opposite side relative to the air inlet.

5. The indoor unit of an air conditioning apparatus according to claim 1, wherein the air outlet has a substantially straight edge portion along a longitudinal direction of the air outlet, and the edge of the airflow direction adjusting member has a substantially straight edge portion along a longitudinal direction of the airflow direction adjusting member.

6. The indoor unit of an air conditioning apparatus according to claim 1, wherein an air inlet side of the airflow direction adjusting member is formed so as to follow the air inlet side of the air outlet.

7. The indoor unit of an air conditioning apparatus according to claim 1, wherein the air outlet is one of at least four such air outlets disposed so as to surround the air inlet, and the airflow direction adjusting member is one of at least four such airflow direction adjusting members disposed in the at least four air outlets, respectively.

8. The indoor unit of an air conditioning apparatus according to claim 7, further comprising additional air outlets disposed between the air outlets in which the airflow direction adjusting members are disposed, forming a continuous air outlet opening.

9. An indoor unit of an air conditioning apparatus comprising an indoor unit casing having an air inlet and an air outlet, the air outlet having an edge on an air inlet side forming a bulge toward the air inlet;

an airflow direction adjusting member covering at least a part of the air outlet, the airflow direction adjusting member having an edge on the air inlet side forming a bulge toward the air inlet; and an airflow direction adjusting control unit configured to adjust a direction of airflow blown out from the air outlet by adjusting a posture of the airflow direction adjusting member, the air outlet being formed such that an inclination of edge surfaces of the air outlet in the neighborhood of lengthwise direction end portions with respect to a horizontal plane is steeper than an inclination of an edge surface of the air outlet in a lengthwise direction center at the downstream most end of the air outlet with respect to the horizontal plane, a direction of airflow blown out from neighborhood of the lengthwise direction end portions of the air outlet being directed more downward than a direction of an airflow blown out from the lengthwise direction center of the air outlet, the airflow direction adjusting control unit being further configured to adjust posture of the airflow direction adjusting member so as to close the air outlet when air conditioning operations are stopped, and the indoor unit being a ceiling-embedded type.

* * * * *